US007871217B2

(12) United States Patent
Kennedy et al.

(10) Patent No.: US 7,871,217 B2
(45) Date of Patent: Jan. 18, 2011

(54) PUMP SYSTEMS FOR PUMP DISPENSERS

(75) Inventors: Timothy James Kennedy, Pleasanton, CA (US); Tami O'Connell, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 1071 days.

(21) Appl. No.: 11/609,749

(22) Filed: Dec. 12, 2006

(65) Prior Publication Data

US 2008/0138144 A1 Jun. 12, 2008

(51) Int. Cl.
*A46B 11/02* (2006.01)

(52) U.S. Cl. ..... 401/188 R; 401/263; 401/265; 222/321.7

(58) Field of Classification Search ..... 401/188 R, 401/28, 261, 263, 264, 265, 266; 222/634, 222/321.1–321.8
See application file for complete search history.

(56) References Cited

U.S. PATENT DOCUMENTS 3,862,806 A * 1/1975 Brown ..... 401/118
4,692,047 A * 9/1987 Endo ..... 401/141
4,986,453 A 1/1991 Lina et al.
5,181,635 A 1/1993 Balderrama
5,242,089 A 9/1993 Knickerbocker
5,360,127 A 11/1994 Barriac
5,445,299 A 8/1995 Harriman
5,544,789 A 8/1996 Gillingham
5,593,094 A 1/1997 Barriac
5,720,419 A 2/1998 Li
5,738,250 A 4/1998 Gillingham
5,738,282 A 4/1998 Grogan
5,908,257 A * 6/1999 Martin ..... 401/271
6,045,008 A 4/2000 Gonzalez Fernandez et al.
6,158,625 A 12/2000 Siegel et al.
6,158,674 A * 12/2000 Humphreys ..... 239/333
6,173,863 B1 1/2001 Brozell et al.
6,173,868 B1 1/2001 DeJonge
6,223,951 B1 5/2001 Siegel et al.
6,257,451 B1 7/2001 Siegel et al.
6,269,976 B1 8/2001 DeJonge
6,338,422 B1 1/2002 DeJonge
6,422,425 B1 * 7/2002 Tada ..... 222/153.07
6,474,508 B1 11/2002 Marsh (Continued)

OTHER PUBLICATIONS http://www.saint-gobain-calmar.com/products.aspx?c=prod&sc=2& pid=20 (Calmar MD3200)—Oct. 19, 2006.

*Primary Examiner*—David J Walczak
(74) *Attorney, Agent, or Firm*—David Peterson

(57) ABSTRACT

A pump dispenser has a large ergonomic actuator designed to ergonomically deliver a composition to a substrate in the consumer's hand without the consumer having to pick up the pump dispenser. The ergonomic design allows the composition to be delivered in a proper aspect ratio to the substrate. The composition can be delivered in such a way that the composition is not aerosolized into the air or delivered to an unintended surface. The method of delivery can be made intuitive to the consumer by providing an actuator skirt that suggests the pumping mechanism or by providing a depiction of a hand or substrate over the pump dispenser. The pump dispenser is also useful for compositions or substrates that are not stable together.

7 Claims, 18 Drawing Sheets

U.S. PATENT DOCUMENTS

| | | | |
|---|---|---|---|
| 6,543,649 | B1 | 4/2003 | Danielo et al. |
| 6,652,869 | B2 | 11/2003 | Suazon et al. |
| 6,695,171 | B2 | 2/2004 | Walters et al. |
| 6,702,157 | B1 | 3/2004 | Dobbs |
| 6,716,805 | B1 | 4/2004 | Sherry et al. |
| 6,729,500 | B1 | 5/2004 | Dobbs et al. |
| 6,779,693 | B2 | 8/2004 | Sweeton et al. |
| 6,953,297 | B2 | 10/2005 | Dobbs |
| 2001/0025863 | A1 | 10/2001 | Lorscheidt et al. |
| 2003/0192913 | A1 | 10/2003 | Prueter |
| 2005/0100391 | A1 | 5/2005 | Dobbs et al. |
| 2005/0224515 | A1 | 10/2005 | Mon et al. |

* cited by examiner

PUMP SYSTEMS FOR PUMP DISPENSERS

BACKGROUND OF THE INVENTION

1. Field of the Invention

This invention relates to pump dispensers for use with substrates such as paper towels, wipes, woven or nonwoven dishcloth, and sponges, and a method of cleaning using these pump dispensers.

2. Description of the Related Art

Consumers have traditionally applied cleaning and disinfecting compositions by spraying on a surface and wiping with a paper towel or by adding a cleaner to a sponge, activating with water, wiping with the sponge, and rinsing the sponge. This procedure is inefficient because the consumer must go through several cleaning steps.

Current dispensers are not adequate for one hand application of cleaning and disinfecting compositions to cleaning substrates such as paper towels. Dispensers such as trigger sprayers or pump dispensers generally require one hand to hold and activate the dispenser and one hand to hold the cleaning substrates. Existing pump-up dispensers that can be ergonomically operated with the same hand that holds the cleaning substrate have small actuators that require the hand and substrate to be contracted into a ball in order to activate the dispenser.

Wet disinfectant or cleaning wipes, such as described in U.S. Pat. No. 6,716,805 to Sherry et al., are becoming increasingly popular for their convenience in combining a nonwoven, disposable substrate with a disinfecting or cleaning solution. Soap-loaded disposable dish cloths, as described in U.S. Pat. No. 6,652,869 to Suazon et al., are also popular for their convenience. These products combine the cleaning solution and the cleaning substrate in one system so that the consumer can perform the cleaning task with one hand and with one product. However, these systems have some drawbacks such as requiring water activation of a dry substrate or requiring a sealed packaging for a wet substrate.

To overcome these problems of cleaning systems and cleaning products, the cleaning device and cleaning system of the present invention is designed to allow the consumer to conveniently apply a cleaning or disinfecting composition to a substrate with one hand and in a controlled manner.

SUMMARY OF THE INVENTION

In accordance with the above objects and those that will be mentioned and will become apparent below, one aspect of the present invention comprises a system for distributing fluid from a container to a substrate, the system comprising a pump having an inside volume compressible to a reduced volume and expandable to a resting volume; a dip tube for fluidly communicating a fluid in the container to the inside volume; a check ball or other inlet valve for preventing fluid to flow from the pump into the container when the pump is compressed to the reduced volume, thereby allowing the fluid in the pump to be pressurized; a plurality of orifices in a top surface of the inside volume; a flexible layer covering the plurality of orifices and forming an actuator top; at least one of slots or holes formed in the flexible layer, wherein the slots or holes prevent passage of fluid from the actuator top into the inside volume.

In accordance with the above objects and those that will be mentioned and will become apparent below, another aspect of the present invention comprises a system for distributing fluid from a container to a substrate, the system comprising a bellows-type pump having a bellows compressible to a reduced volume and expandable to a resting volume; a dip tube for fluidly communicating a fluid in the container to the bellows; a check ball or other inlet valve for preventing fluid to flow from the bellows into the container when the bellows is compressed to the reduced volume, thereby allowing the fluid in the bellows to be pressurized; a plurality of orifices in a top surface of the bellows; a flexible layer covering the plurality of orifices and forming an actuator top; at least one of slots or holes formed in the flexible layer, wherein the slots or holes prevent passage of fluid from the actuator top into the inside volume.

In accordance with the above objects and those that will be mentioned and will become apparent below, another aspect of the present invention comprises a system for distributing fluid from a container to a substrate, the system comprising a pump having an inside volume compressible to a reduced volume and expandable to a resting volume, the pump being maintained at the resting volume by at least one spring; an actuator forming a top surface of the inside volume; a dip tube for fluidly communicating a fluid in the container to the inside volume; a check ball or other inlet valve for preventing fluid to flow from the inside volume into the container when the inside volume is compressed to the reduced volume, thereby allowing the fluid in the inside volume to be pressurized; a plurality of orifices in the actuator; a flexible layer covering the plurality of orifices and forming an actuator top; at least one of slots or holes formed in the flexible layer, wherein the slots or holes prevent passage of fluid from the actuator top into the inside volume.

BRIEF DESCRIPTION OF THE DRAWINGS

In the accompanying drawings that form part of the specification, and in which like numerals are employed to designate like parts throughout the same.

DETAILED DESCRIPTION OF THE INVENTION

Figure 1:
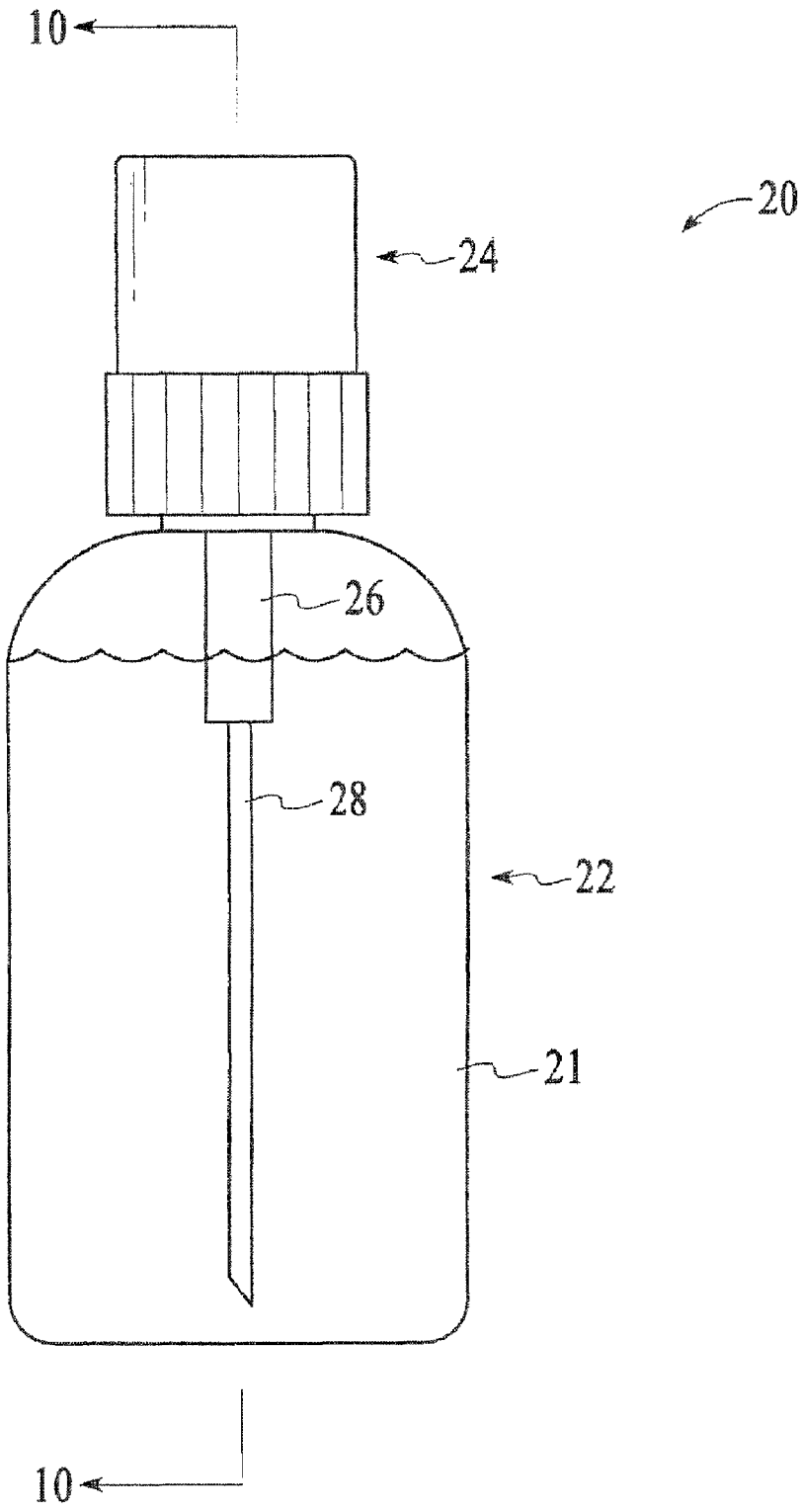
FIG. 1 is a front view of a first embodiment of a pump dispensing package of the present invention, and the package is shown assembled in a condition prior to use.

While this invention is susceptible of embodiment in many different forms, this specification and the accompanying drawings disclose only some specific forms as examples of the invention. The invention is not intended to be limited to the embodiments so described. It is also to be understood that the terminology used herein is for the purpose of describing particular embodiments of the invention only, and is not intended to limit the scope of the invention in any manner. The scope of the invention is pointed out in the appended claims.

For ease of description, the components of this invention and the container employed with the components of this invention are described in the normal (upright) operating position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. All percentages, ratios and proportions are by weight, and all temperatures are in degrees Celsius (° C.), unless otherwise specified. All measurements are in SI units, unless otherwise specified. Unless otherwise stated, amounts listed in percentage ("%'s") are in weight percent (based on 100% active) of the cleaning composition alone. It should be understood that every limit given throughout this specification will include every lower, or higher limit, as the case may be, as if such lower or higher limit was expressly written herein. Every range given throughout this specification will include every narrower range that falls within such broader range, as if such narrower ranges were all expressly written herein.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic, cationic and/or amphoteric agents.

The composition can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established.

An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "plastic" is defined herein as any polymeric material that is capable of being shaped or molded, with or without the application of heat. Usually plastics are a homo-polymer or co-polymer that of high molecular weight. Plastics fitting this definition include, but are not limited to, polyolefins, polyesters, nylon, vinyl, acrylic, polycarbonates, polystyrene, and polyurethane.

Package

FIG. 1 illustrates a package 20 employing an actuator 24, a pump assembly 26, and a dip tube 28 installed on a container 22. In this embodiment, the container 22 is transparent and contains a cleaning composition 21.

Figure 2:
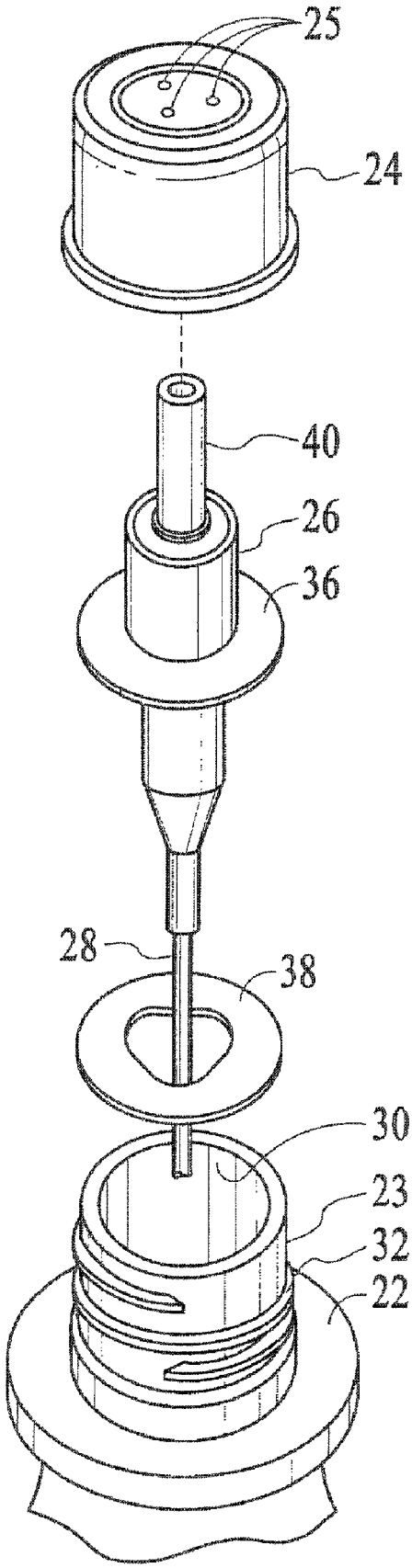
FIG. 2 is a fragmentary, exploded, perspective view of the package illustrated in FIG. 1.

FIG. 2 illustrates a typical pump assembly 26 that may be employed on the container 22 and which is adapted to be mounted in the neck 23 of the container 22. The exterior of the container neck 23 typically defines the threads 32 for engaging the closure (not shown) as described in detail hereinafter. The threads 32 define a connection feature adjacent the container mouth 30. Other connection features may be employed in cooperation with mating or cooperating connection features on the closure, and such other connection features could be a snap-fit bead and groove arrangement or other conventional or special connection features, including non-releasable connection features such as adhesive, thermal bonding, staking, etc.

A part of the pump assembly 26 may extend into the container opening or mouth 30. The pump assembly 26 may be of any suitable conventional or special type. With a typical conventional pump assembly 26, the bottom end of the pump assembly 26 is attached to a conventional dip tube 28, and the upper end of the pump assembly projects above the container neck 23. The pump assembly 26 includes an outwardly projecting flange 36 for supporting the pump assembly 26 on the container neck 23 over a conventional sealing gasket 38 which is typically employed between the pump assembly flange 36 and container neck 23. Other sealing designs such as plug seals can be used in place of a gasket. The hollow stem or tube 40 establishes communication between the pump chamber (not shown) within the pump assembly 26 and an actuator 24 which is mounted to the upper end of the tube 40.

The actuator 24 defines a discharge passage 44 (FIG. 10) through which the product from the stem or tube 40 is discharged. The actuator 24 has a hand-and-substrate engageable region (FIG. 9) and can be depressed by the user's hand containing a substrate to move the stem 40 downwardly (FIG. 10) in the pump assembly 26 to dispense fluid from the pump assembly 26. The fluid is pressurized in the pump chamber and exits from the actuator orifices 25 (FIG. 2) in the actuator 24.

It will be appreciated that the particular design of the pump assembly 26 may be of any suitable design for pumping a product from the container 22 (with or without a dip tube 28) and out through the stem 40. The detailed design and construction of the pump assembly 26 per se forms no part of the present invention except to the extent that the pump assembly 26 is adapted to be suitably mounted and held on the container by a closure with a suitable mounting system.

While the present invention may be practiced with spray or liquid pumps of many different designs, the internal design configuration of one suitable pump is generally disclosed in U.S. Pat. No. 4,986,453, the disclosure of which is hereby incorporated herein by reference thereto. It should be understood, however, that the present invention is suitable for use with a variety of hand-operable pumps.

Container

Figure 5:
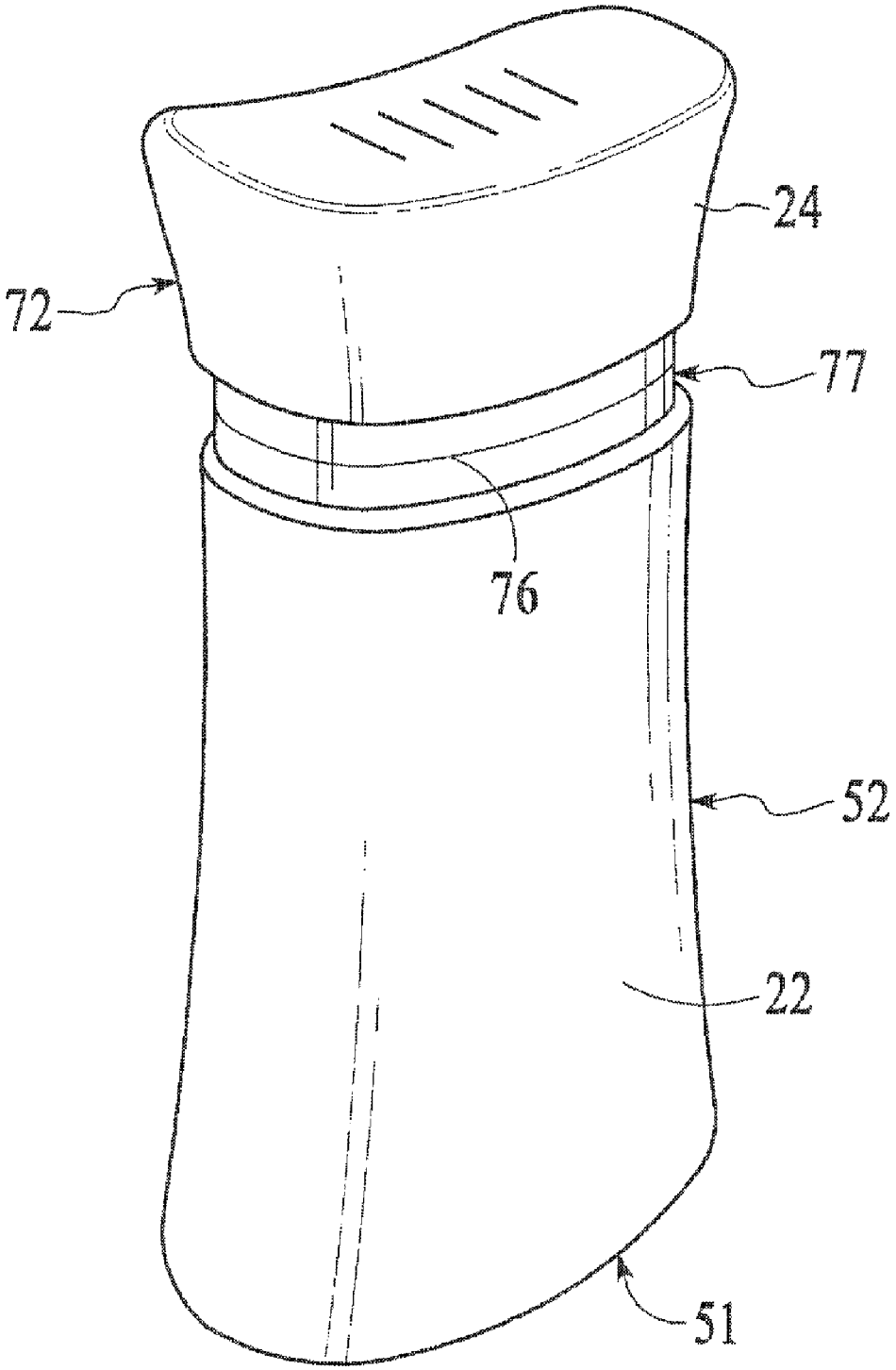
FIG. 5 is a perspective view of an embodiment of a pump dispensing package of the present invention, and the package is shown assembled in a condition prior to use.

The dispensing package (FIG. 5) can comprise a container 22 having a container bottom 51; a container sleeve 52 coupled to said container bottom 51 and depending upwardly from the peripheral edge of said container bottom 51; an actuator 24 having an actuator top 72 and an actuator skirt 76 coupled to the actuator top 72 and depending downwardly from the peripheral edge of said actuator top 72; a pump assembly 26 (FIG. 2) having a hollow stem 40 and the pump assembly 26 disposed within the container 22 and in fluid communication with the actuator 24; wherein the actuator 24 has at least one discharge orifice 25 in fluid communication with the stem 40 of the pump assembly 26 to permit liquid to flow on to a top surface 74 (FIG. 7A) of the actuator top 72 upon reciprocation of the actuator top 72, and wherein a sleeve interior surface of the container sleeve 52 is slideably engagable with a skirt exterior surface 77 of the actuator skirt 76 (FIG. 5).

Figure 3:
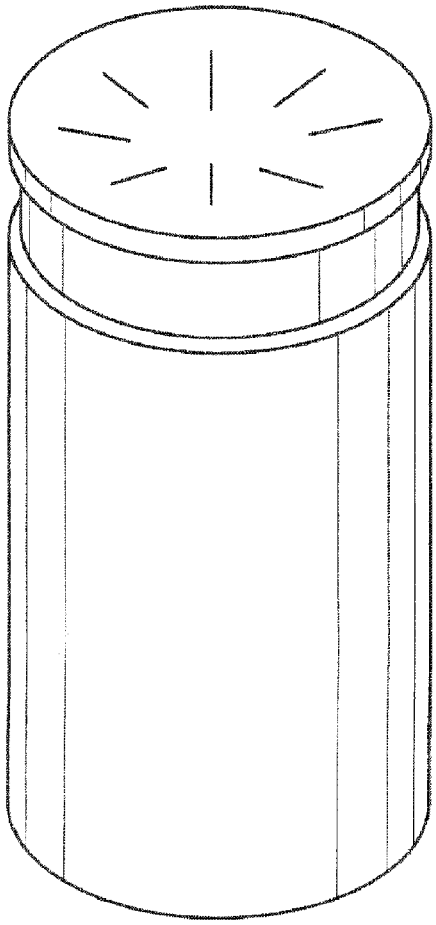
FIG. 3 is a perspective view of an embodiment of a pump dispensing package of the present invention, and the package is shown assembled in a condition prior to use.
Figure 4:
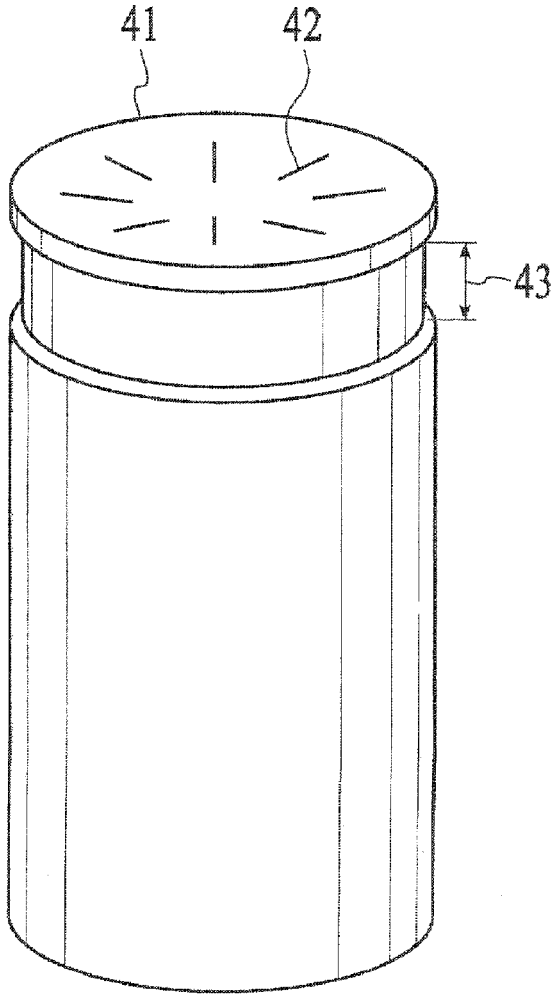
FIG. 4 is a perspective view of an embodiment of a pump dispensing package of the present invention, and the package is shown assembled in a condition prior to use.
Figure 7A:
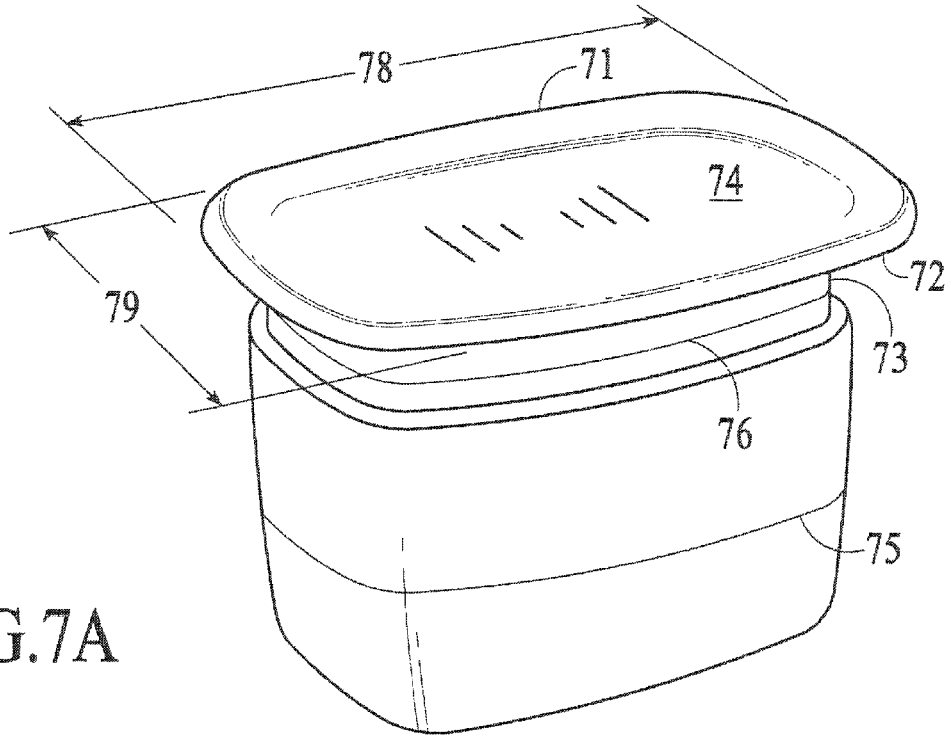
FIG. 7A is a perspective view of an embodiment of a pump dispensing package of the present invention, and the package is shown assembled in a condition prior to use.
Figure 7B:
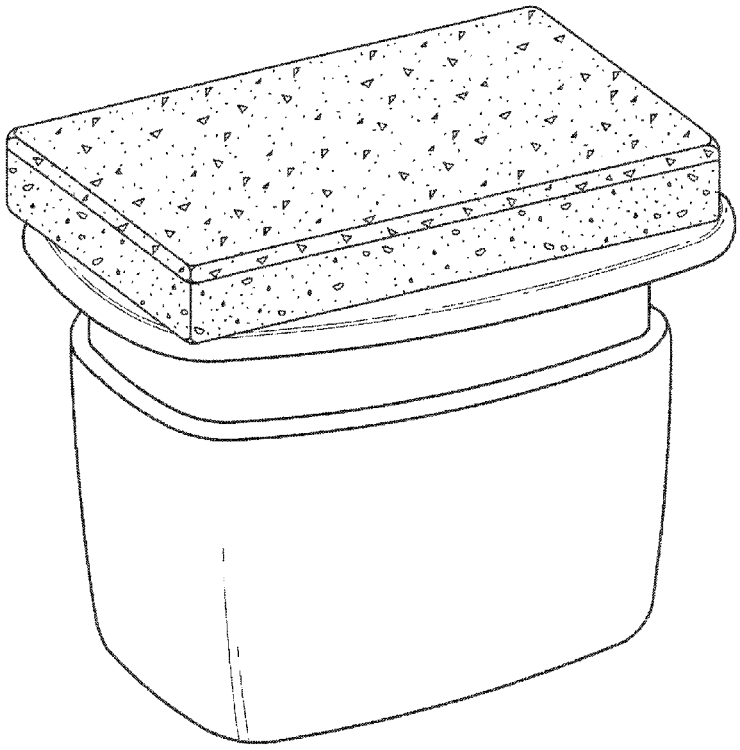
FIG. 7B is a perspective view of an embodiment of a pump dispensing package of the present invention showing a sponge sitting on top of the package.

The container can have a variety of shapes. The container can be round (FIG. 3) or oval (FIG. 4) or rectangular with rounded corners (FIG. 7A). The container dimensions can be measured from a horizontal slice 75 (FIG. 7A). The container can be made from plastic materials. The container, and other components of the dispenser package, can be constructed of any of the conventional material employed in fabricating containers, including, but not limited to: polyethylene; polypropylene; polyacetal; polycarbonate; polyethylene-terephthalate; polyvinyl chloride; polystyrene; blends of polyethylene, vinyl acetate, and rubber elastomer. Other materials can include stainless steel and glass. A suitable container is made of clear material, e.g., polyethylene terephthalate.

Actuator

The ergonomic shape of the actuator makes the actuator easy to pump with a substrate such as paper towel or sponge, and to operate using one hand. One measure of the actuator shape is a vertical projection 71 (FIG. 7A) of the top surface 74 of the actuator top 72, where a vertical projection is a projection onto the horizontal plane. The vertical projection 71 has a length 78 and a width 79. The aspect ratio is the ratio of the length to the width. For a circle, the aspect ratio would be 1. Unless the hand or the substrate in the hand is severely compressed, then both the hand and substrate would have an aspect ratio greater than 1. In order to ergonomically apply the composition to the substrate in the hand, in some embodiments of the invention it would be desirable for the actuator and or the pattern of orifices to have an aspect ratio greater than 1. The vertical projection of the actuator top can have an aspect ratio of greater than 1, or greater than 1.1, or greater than 1.2, or greater than 1.5, or at least 1.1, or at least 1.2, or at least 1.5, or less than 2, or less than 1.5. In order to provide a large surface for one-handed use of the dispensing package, in some embodiments, the actuator top size can be approximately the same size or larger than the container. The actuator top size can be larger than the width of two fingers for easy ergonomic use with a cleaning substrate. The vertical projection of the actuator top length can be larger than about 1.5 inches, or from 2 to 10 inches, or from 2 to 8 inches, or from 2 to 5 inches, or from 2 to 3 inches, or from 2.5 to 8 inches, or from 2.5 to 5 inches, or from 2.5 to 3 inches. The vertical projection of the actuator top can have an area of greater than 2 square inches, greater than 5 square inches, greater than 6 square inches, greater than 7 square inches, greater than 8 square inches, greater than 10 square inches, less than 8 square inches, less than 10 square inches, or less than 20 square inches. For use with a semi-rigid rectangular substrate, for example a sponge, the actuator top can be approximately the same size or somewhat smaller than a standard rectangular sponge, for example about 2.5 by about 4.5 inches. The vertical projection of the top surface of the actuator top can have at least one dimension that is greater than the corresponding dimension of any horizontal slice 75 of the container (FIG. 7A). The vertical projection of the top surface of the actuator top can have at least one dimension that is greater than the corresponding dimension of any horizontal slice 75 of the actuator skirt (FIG. 7A).

Figure 6:
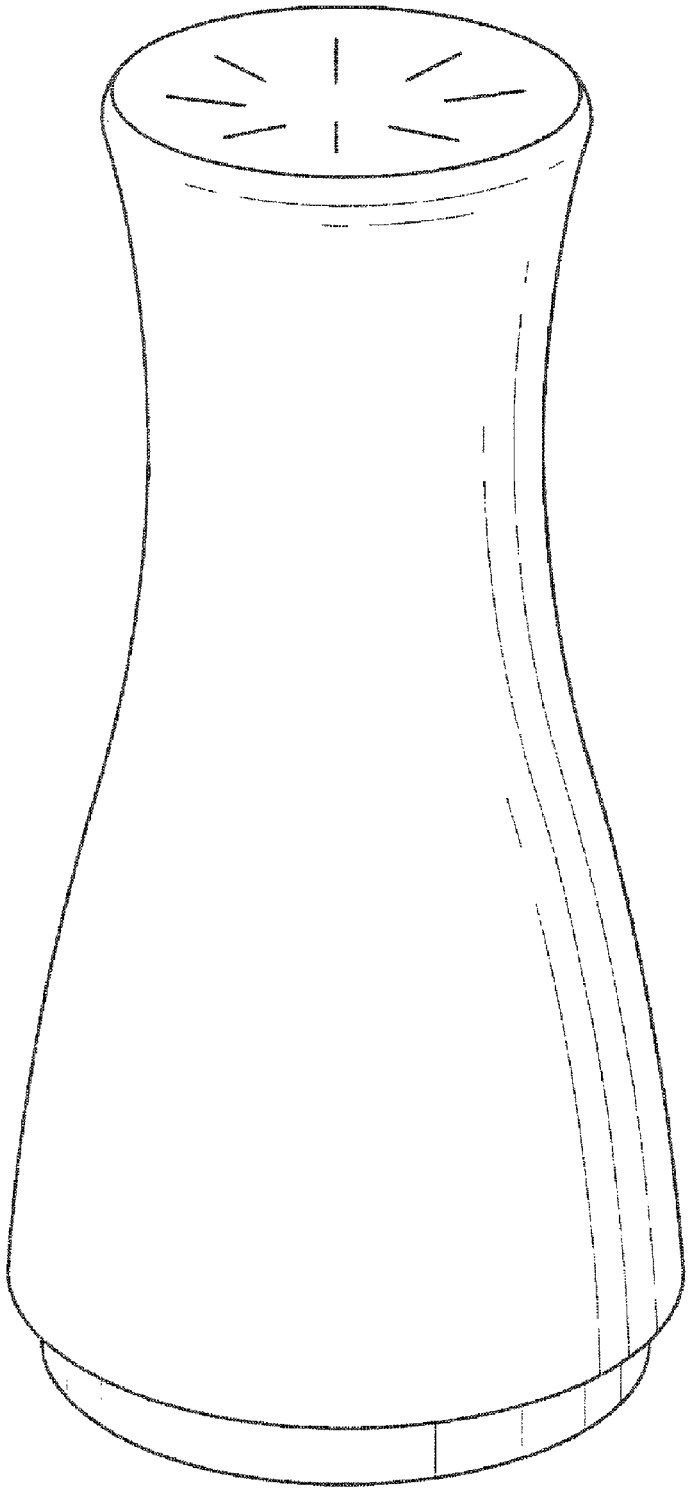
FIG. 6 is a perspective view of an embodiment of a pump dispensing package of the present invention, and the package is shown assembled in a condition prior to use.
Figure 8:
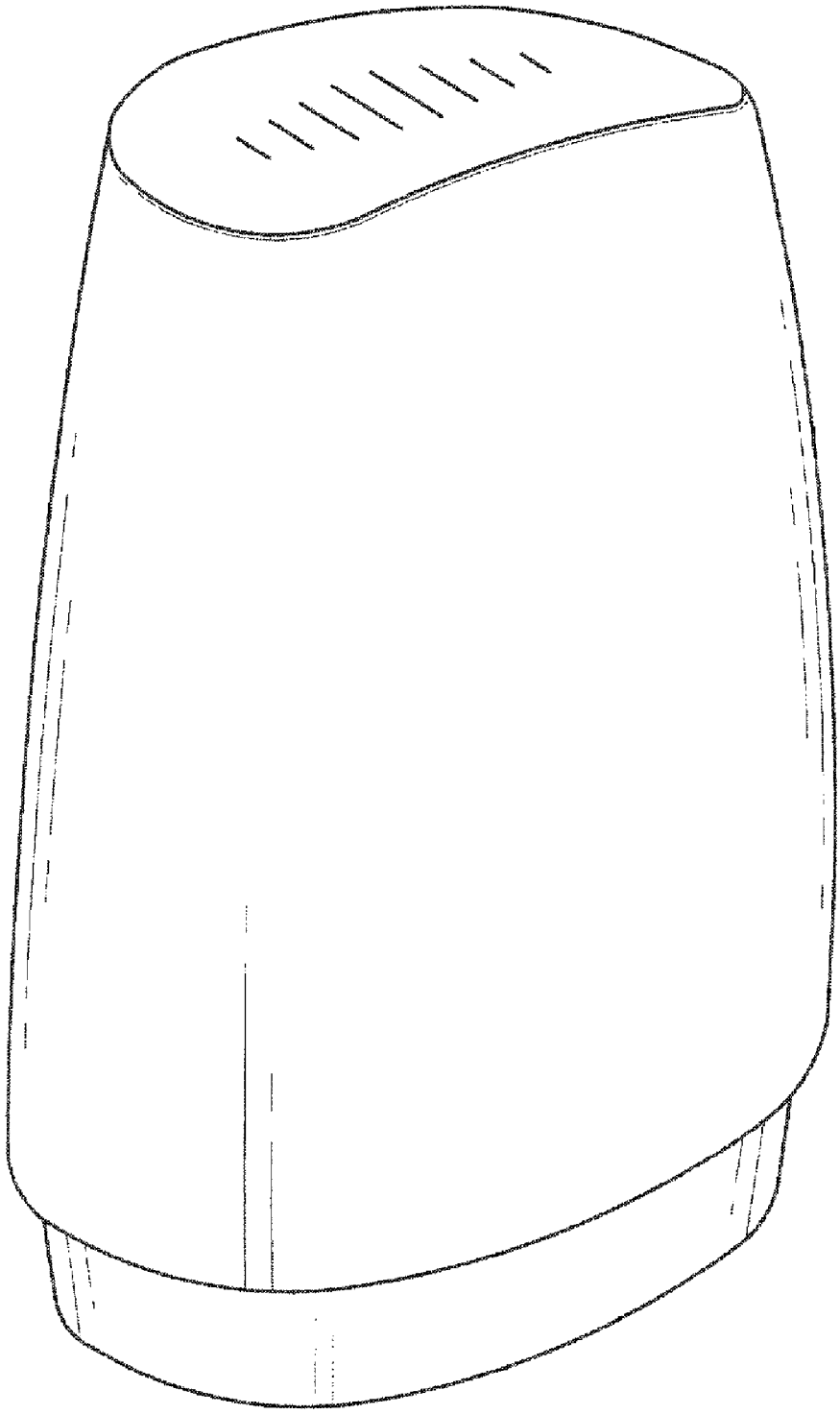
FIG. 8 is a perspective view of an embodiment of a pump dispensing package of the present invention, and the package is shown assembled in a condition prior to use.

The actuator can have a concave shape that is round (FIG. 3, FIG. 6), oval (FIG. 4, FIG. 5, FIG. 8), a rectangular with rounded corners (FIG. 7A), elliptical, or other shape that fits the hand, a sponge, or other substrate. The concave shape allows the capture or excess composition without dripping. In certain embodiments, it may be desirable to allow pools of the composition to collect in the actuator top 42 (FIG. 4) during use. The actuator can have a rim 41 to prevent spillage. In certain embodiments, it may be useful for the actuator to be flat or convex for ergonomic effectiveness with certain substrates.

The actuator can individually be adapted to the respective requirements with regard to the direction of the dispensing opening as well as with regard to the use of opening valves. The actuator is not limited to having a dispensing opening which is moved together with a dispensing key, but it may also comprise an actuator of the type having a stationary dispensing opening. The actuator may have a surface that engages the container and is internal (FIG. 4) or external (FIG. 6, FIG. 8) to the container.

Actuator Skirt

The actuator skirt can be indented from the actuator top (FIG. 7A). The actuator skirt dimensions can be measured from a horizontal slice of the actuator skirt 76. Because this dispenser package may be unfamiliar to consumers, it may be necessary to provide a consumer cue on how to use the dispenser package by pushing down on the actuator. Therefore, before activation of the package, it may be desirable that a portion of the actuator skirt is visible to a user of the package thereby providing operational indicia to the user of the package. This provides a consumer cue to push down on the actuator. It may be desirable that before activation, the visible portion of the actuator skirt has a vertical dimension 43 (FIG. 4) of about one-eighth inch, at least one-eighth inch, or at least one-quarter inch, or at least one-half inch, or at least one inch. By the same notion, it may be desirable that after downward activation of the package, the actuator top extends beyond the circumference of the container (FIG. 7A). An actuator skirt that is indented from the actuator top or is a different color from the actuator top or the container may provide a consumer cue as to how to use the dispensing container.

Actuator Orifices

The package can have one or more openings or orifices 25 situated on the actuator 24 (FIG. 2). The orifice can be a small or large, round, slit or other suitable shape. The orifice or orifices can be centered in the actuator. Because the actuator is enlarged, the orifice or orifices can be located away from the edge of the actuator to prevent, for example, spilling the composition. The actuator top can have multiple orifices and the orifices can be indented from the exterior edge of the top surface of the actuator top. The actuator top can have multiple orifices wherein the pattern of orifices has an aspect ratio of at least 1.5, or greater than 1, or greater than 1.1, or greater than 1.2, or greater than 1.5, or at least 1.1, or at least 1.2, or less than 2, or less than 1.5. Where the pattern of orifices has an aspect ratio of at least 1.5, then the composition can be applied to the substrate in an area having an aspect ratio of at least 1.5, or greater than 1, or greater than 1.1, or greater than 1.2, or greater than 1.5, or at least 1.1, or at least 1.2, or less than 2, or less than 1.5. When for example the actuator top is large and has multiple orifices, the actuator can apply at least 0.3 ml of the composition (or other volume) to the substrate in an area of greater than 2 square inches and less than 20 square inches, or an area of greater than 4 square inches, greater than 5 square inches, greater than 6 square inches, greater than 7 square inches, greater than 8 square inches, greater than 10 square inches, less than 8 square inches, less than 10 square inches, or less than 20 square inches.

Delivery Volume

The delivery or application volume should give satisfactory delivery of the composition in one stroke of the actuator component. For consumer flexibility, the consumer may also use more than one stroke of the actuator component for the to 1 ml, or 1 to 5 ml, or 1 to 2 ml, or about 0.3 ml, or about 0.7 ml.

Locking Means/Cover

The dispensing package may have a flip-top cover as described in U.S. Pat. No. 6,953,297 to Dobbs et al. The dispensing package may have a retractable cover as described in U.S. Pat. No. 6,223,951 to Siegel et al. The dispensing package may have a rotatable or removeable sleeve to prevent actuation as described in U.S. Pat. No. 6,543,649 to Danielo et al. The dispensing package may have a rotative locking mechanism or a removable anti-rotative lock as described in U.S. Pat. No. 5,445,299 to Harriman.

Durable or Disposable Package

The package may be disposable and designed for one use and not designed to be refillable. In this embodiment, the actuator and/or pump assembly may be fused to the container, for example with spot welding.

The package may be durable and able to be refillable. In one embodiment, the package is refilled by pouring additional composition into the container through a neck opening in the container. In one embodiment, a durable pump assembly and actuator is attached to a disposable container assembly containing a composition. In one embodiment, a durable pump assembly, actuator and container assembly is adapted to allow attachment of a refill container.

Refill Assembly

In some embodiments, the dispenser package can be refilled with a refill assembly. In order to prevent attaching a refill that may be inappropriate for the actuator or the intended use, in some embodiments the refill is designed to have novel characteristics. For example, the refill assembly may be coupled to the actuator using a non-standard closure. In one embodiment, either a rigid cartridge or flexible pouch is inserted into a rigid container with some mechanism to attach the pump and actuator. The attachment mechanism can be, for example, that the pump and actuator is inserted into a refill with a film seal, for example as described in U.S. Pat. No. 6,269,976 to DeJonge which describes a puncture spike with a dip tube guide. In another embodiment, the refill assembly has a restricted neck to discourage refilling by the consumer.

Figure 11A:
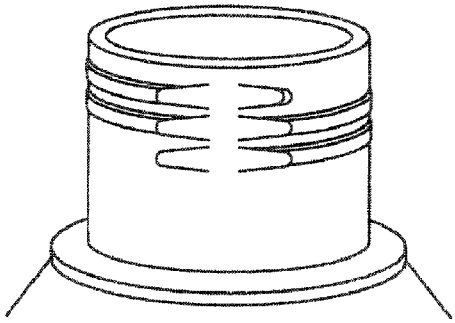
FIGS. 11A and 11B are perspective views of an embodiment of a refill closure of the present invention.
Figure 11B:
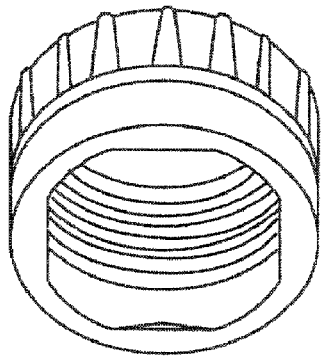

In another embodiment, the refill assembly has a non-standard closure, such as non-standard neck threads or tabs, so that a standard threaded closure cannot be used. One example is a key hole closure which in one embodiment comprises a threaded female fitting, modified so a completely threaded male fitting can not be engaged in the female fitting, and a matching male fitting. The threaded female fitting, such as a bottle closure, has an extended skirt and one or more restrictions in the skirt to prevent a completely threaded male fitting from being used. The skirt is long enough that the matching male fitting can be pushed into the female fitting far enough to clear the restriction before the threads start to engage. FIGS. 11A and 11B show one embodiment of this design. The threads on the male part have been truncated on four sides. The female part has four wedges added at the bottom of the skirt to provide a partially squared opening that matches the cross section of the threaded portion of the male part with enough clearance that the male part can be easily inserted into the female part until the threads start to engage. At that point the threads have cleared the wedges so the two parts can be screwed together.

Figure 12A:
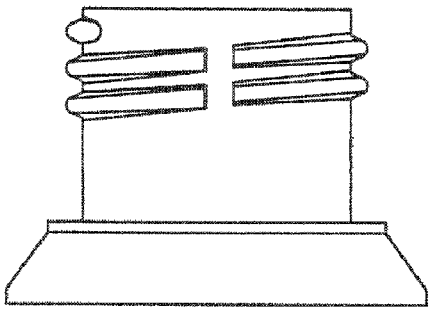
FIGS. 12A and 12B are perspective views of an embodiment of a refill closure of the present invention.
Figure 12B:
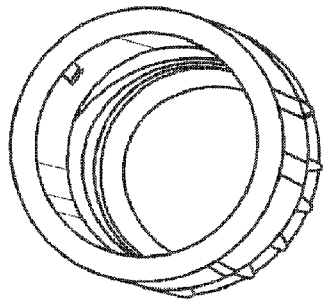
Figure 13A:
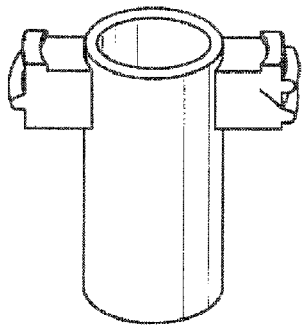
FIGS. 13A and 13B are perspective views of an embodiment of a refill closure of the present invention.
Figure 13B:
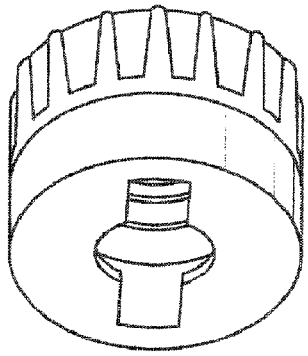

In another embodiment of the key hole closure, the modification to the threads in this case is a 0.10" wide, vertical channel on one face only (FIG. 12A). The matching female part (FIG. 12B) has a protrusion that must slide through the channel on the male part before the threads engage. In another embodiment of the key hole closure, the opening in the male part is smaller diameter than the threads, so the threads project from the sides of the male part (FIG. 13A). The opening in the female part matches the cross section of the male part (FIG. 13B).

Figure 14A:
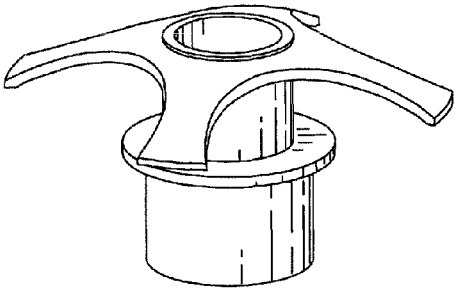
FIGS. 14A and 14B are perspective views of an embodiment of a refill closure of the present invention.
Figure 14B:
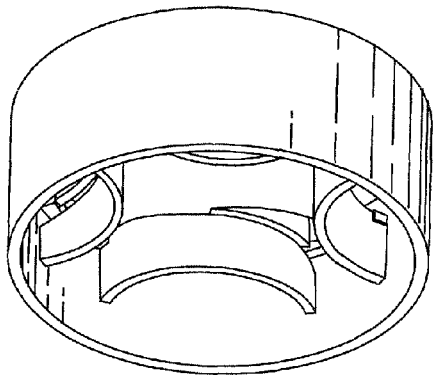

In one embodiment, a flex closure has a male part with a neck of any cross section shape, which may attach to a container and be hollow to allow access to the container (FIG. 14A). One or more arms protrude from the side of the neck. Prior to connection with the female part, the arms of the male part angle or are curved down. The female part has a central opening large enough to accept the neck of the male part and allow it to rotate (FIG. 14B). The female part also has open channel(s) which allow the protruding arm(s) to be inserted into it. When the female part is turned relative to the male part to connect the parts, the protruding arm first passes through a slot that matches the cross section of the arm and then engages with a ramp that bends the arms upward. The ramp flattens out when the ends of the arms are bent the desired amount. In one embodiment, the arms are bent enough that they end up above the channel that allowed the preceding arm to be inserted into the female part. FIG. 14A shows one embodiment of the male part. This is a bottle fitment and the lower part has a tight fit in the neck of the bottle. There are four arms that curve downward. FIG. 14B shows the female part. The outer surface is a cylinder and there are four partial cylinders on the interior. The space between the partial cylinders provides channels for the arms to enter the female part. Each of the partial cylinders has a slot that allows the arm to be turned until it is inside the partial cylinder. Once the end of the arm clears the partial cylinder wall, the inner portion of the partial cylinder wall ramps up and bends the arms up as the male part continues to turn relative to the female part. The male part can continue to turn until the arm is stopped by the wall of the next partial cylinder. At this point the arm is supported on an annular ring that is the flat portion of the ramp and the arm is above the entry channel for the next arm.

Figure 15:
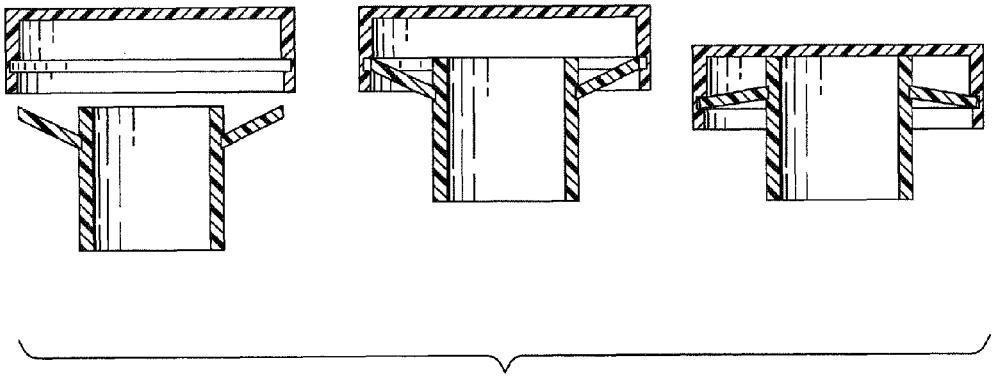
FIG. 15 shows three cross-sectional views of an embodiment of a refill closure of the present invention.

In one embodiment, a flip closure is a connection system with male and female parts (FIG. 15). The parts are pushed together along a central axis to make the connection. The male part has a neck of any cross section shape parallel to the central axis. The neck can be solid or hollow and if hollow can be connected to a container and allow access to the container. Either the male or female part has one or more arms protruding from it and angled toward the second part before they are connected. The second part has two or more surfaces extending radially toward the first part when the parts are connected. These surfaces are perpendicular enough to the central axis to keep the arms from sliding past them. The length of the arms allows the parts to be pushed together until the arms contact one extending surface on the second part. As the parts continue to be pushed together the arms bend or rotate until they are angled away from the direction they were initially angled and are prevented from moving by a second extending surface. The second extending surface does not extend as far as the first surface, so the arms do not contact it until they are partially bent or rotated. The length of the arms is such that compression on the arms from contact with the second part increases and then decreases as the connection is made so that the final position of the two parts is stable. The arms are held to the first part by one or more hinges, or are integral to the first part and flexible enough to bend, or the ends of the arms are prevented from sliding parallel to the central axis by surfaces extending radially toward the second part. The three drawings (FIG. 15) are cross sections of the two parts which illustrate an embodiment of this design where the neck is a hollow cylinder and the arms are connected to the male part. The arms are scored where they connect to the neck to control where they bend. The first drawing shows the parts before connection. The second drawing shows the parts as the arms initially contact the first extended surface. The third drawing shows the completed connections with the arms angled away from their initial position and contacting the second extended surface.

Figure 16:
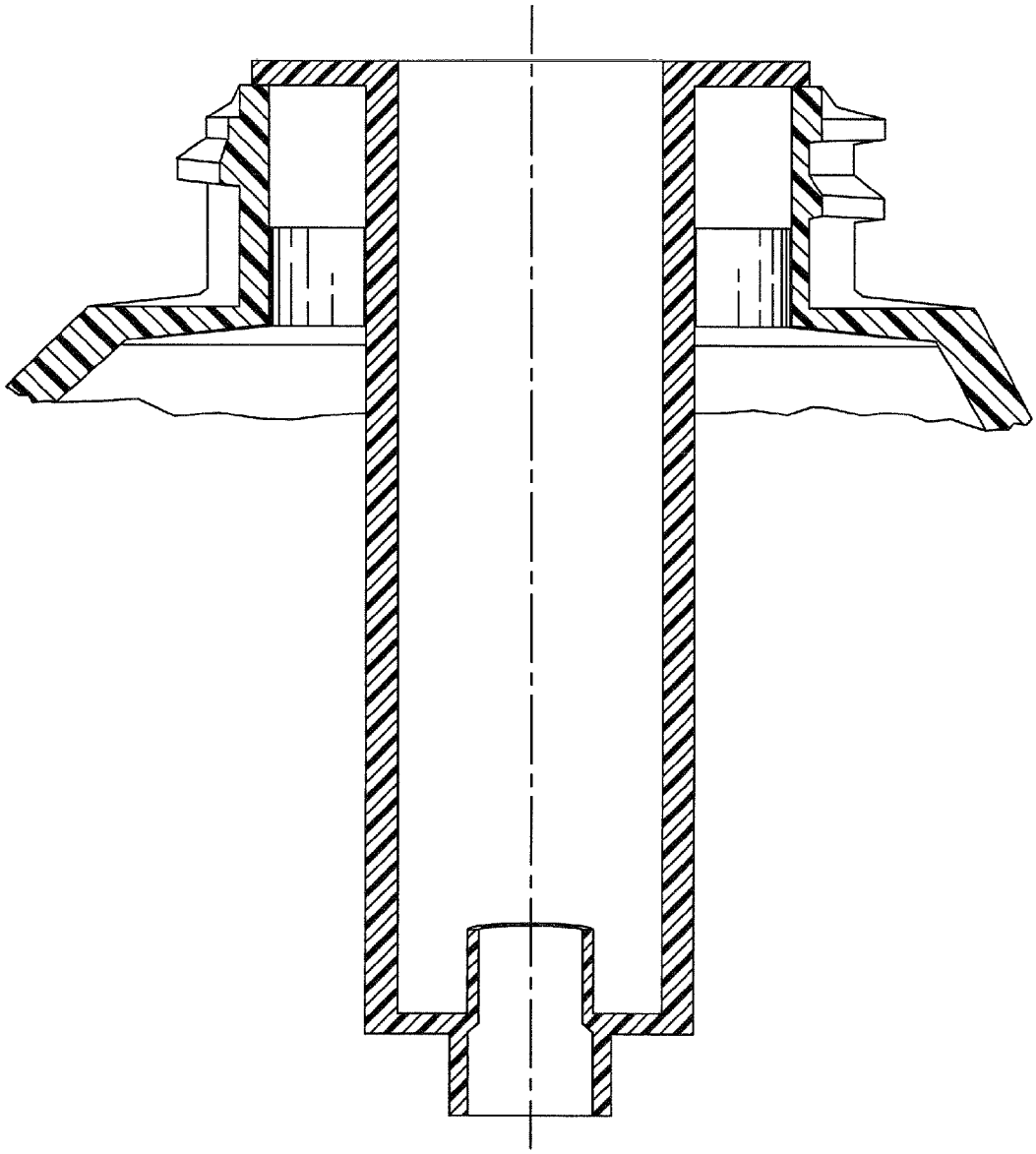
FIG. 16 shows a cross-sectional view of an embodiment of a refill closure of the present invention.

In one embodiment, the fitment closure (FIG. 16) is used with a fluid dispenser that is fed from a dip tube, such as a lotion pump or trigger sprayer. The dip tube, and possibly additional parts of the fluid dispenser such as the check ball, are attached to a fitment which holds the dip tube in place in the container which the fluid dispenser is attached to. The fitment can be attached to the container or simply held in place between the fluid dispenser and container when they are connected. The fitment has a means of attaching a dip tube, such as a socket the dip tube fits into or a male extension the dip tube fits around. The fitment also has a means of sealing it to the fluid dispenser tightly enough that fluid will pass through the dip tube when the fluid dispenser is actuated. The drawing shows one embodiment of the fitment design. The fitment is shown in position in a bottle neck but without the dip tube. The top portion of this design has a skirt sized to friction fit in the bottle's neck. The socket at the bottom of the drawing accepts a dip tube. The adjacent protrusion inside the fitting fits into the dip tube socket on a lotion pump.

In another embodiment, the container has a closure that is broken off when the consumer removes the container so that it cannot be reattached. In another embodiment, the refill has a flange and offset opening in the neck, for example as described in U.S. Pat. No. 6,702,157 to Dobbs. In other embodiment, the refill has a specifically designed vent opening to mate with the actuator pump assembly, for example the cap vent assembly as described in U.S. Pat. No. 5,181,635 to Balderrama et al. In another example, the refill container has locking rachet teeth, for example as described in U.S. Pat. No. 5,360,127 to Barriac et al.

Multiple Compartments

The package may have a swivel actuator that allows selection from multiple compartments as described in U.S. Pat. No. 2003/0192913 to Preuter et al. The package may have multiple actuator components for delivering multiple compositions from one container having multiple compartments, for example a hard surface cleaner and a dish soap.

Fluid Distribution System

When the actuator orifices cover a large area, it may be desirable to have a fluid distribution (or manifold type) system to deliver the fluid from the hollow stem 40 to the orifices 25 (FIG. 2). As described in more detail below with reference to FIG. 17A through FIG. 24C, the fluid distribution system of the present invention may deliver fluid to an area of the top surface of an actuator top greater than the circumferential or cross-sectional area of the tube 40. As used herein, the term "fluid distribution system" refers to a system for dispensing a fluid delivered to the system (such as by pump assembly 26) to a desired location (such as the top surface 74 of an actuator top 72).

Figure 17:
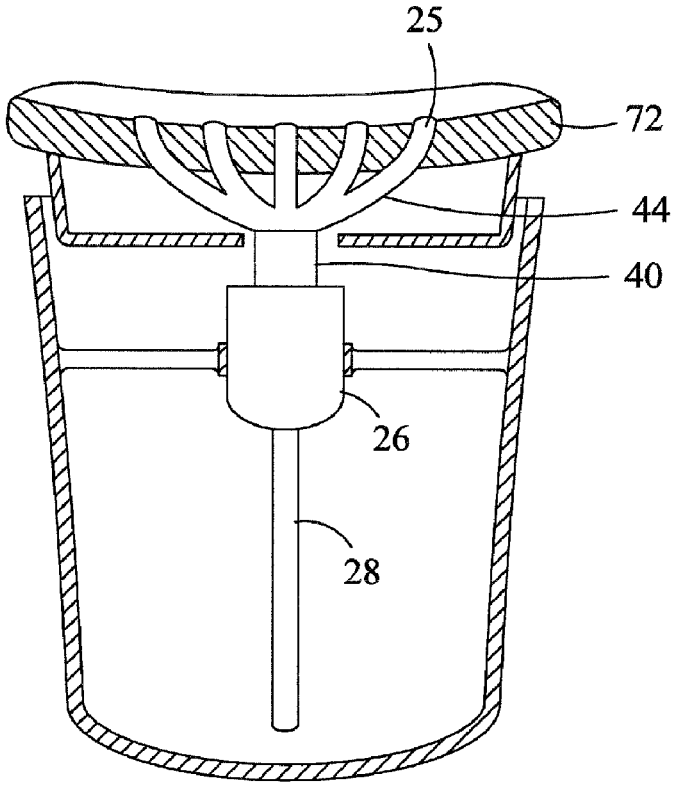
FIG. 17 shows a cross-sectional view of an embodiment of a pump dispensing package having a fluid distribution system of the present invention.

FIG. 17 shows an embodiment of the present invention with a manifold type subsystem where channels 44 are utilized to move the fluid to the surface with orifices 25 organized over the channel openings. In one embodiment, the channel paths are all the same distance so that fluid is evenly distributed with every pump.

Figure 18A:
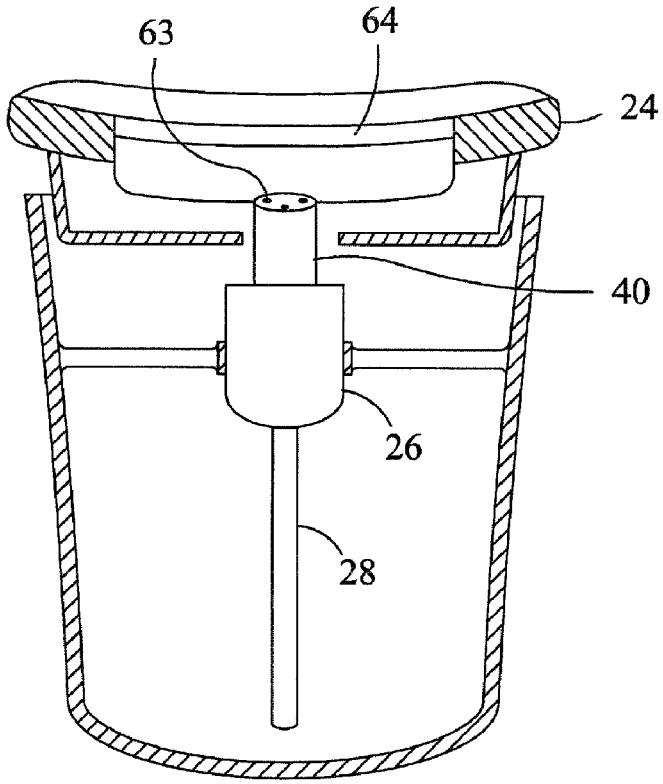
FIGS. 18A and 18B show cross-sectional views of embodiments of a pump dispensing package having a fluid distribution system of the present invention.
Figure 18B:
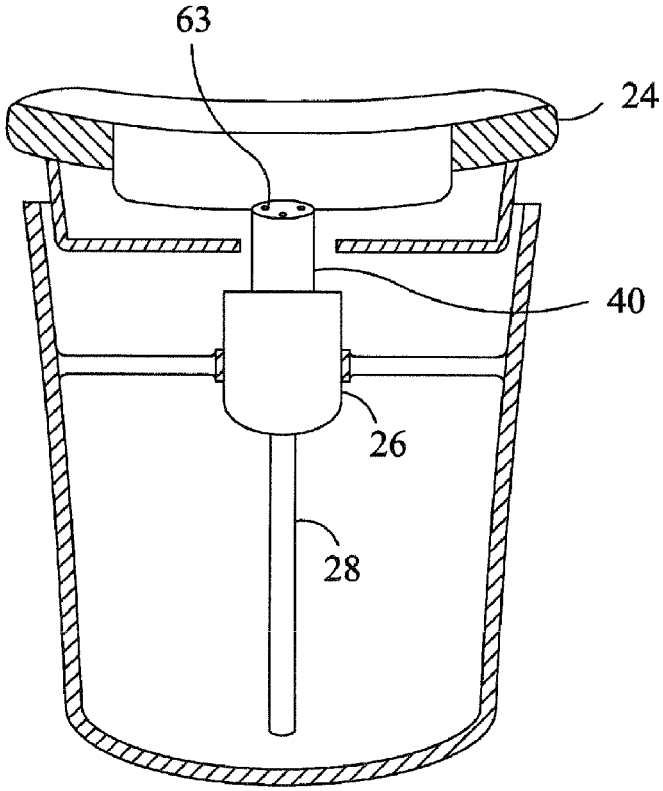

FIG. 18A shows an embodiment of the present invention that includes a spray type distribution subsystem having a distribution spacer 63, such as used in trigger and pump sprayers, that splits the main stream into several tiny streams of liquid. This embodiment might include a complex push pad 64 that allows the fine streams to escape through the holes. FIG. 18B shows an embodiment of the present invention that includes a spray type distribution subsystem using a fine mist spray approach, similar to that common finger pumps utilize, but with a vertical mist. In this embodiment, the user holds the substrate over the push pad actuator 24, pushes down and the actuation would be a fine mist spray up onto the substrate. The fine mist spray results in a fluid flow contacting the substrate at an area greater than conventional finger pumps, which may only deliver a fluid in a circumferential area of the tube 40.

Figure 19:
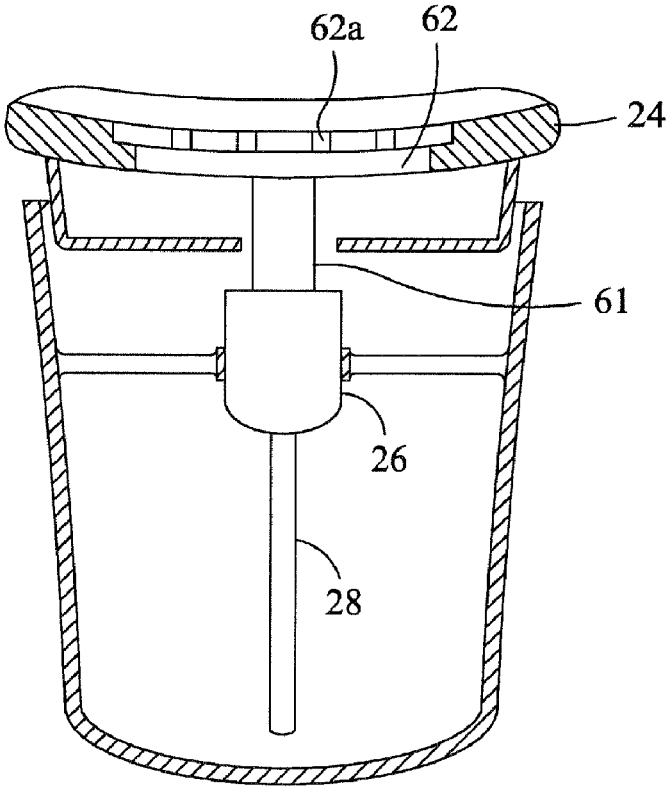
FIG. 19 shows a cross-sectional view of an embodiment of a pump dispensing package having a fluid distribution system of the present invention.

FIG. 19 shows an embodiment of the present invention that includes a surface distribution channel fluid distribution subsystem having a shallow fluid reservoir 61 that collects the fluid and then a thin press pad 62 with holes 62*a* squeezing or pressing the fluid out of the surface holes 62*a*. The holes 62*a* may deliver the fluid on the press pad 62 in an area significantly greater than the circumferential conventionally delivered by only the tube 40.

Figure 20A:
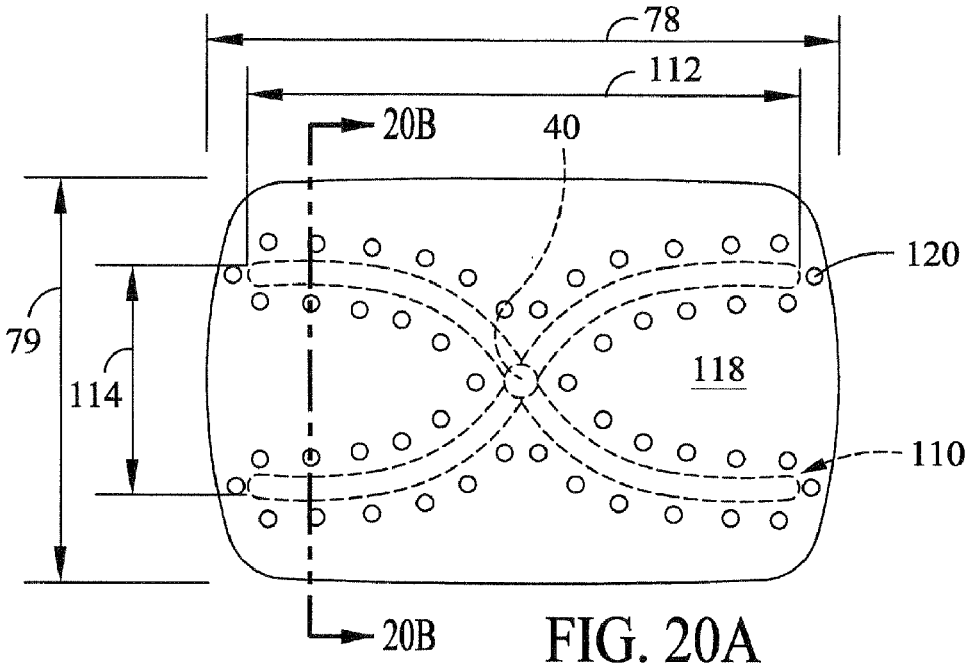
FIG. 20A shows a cross-sectional view of an embodiment of a fluid distribution system of the present invention.

FIG. 20A shows an embodiment of a fluid distribution system having a surface distribution channel 110 along the top surface 74 of the actuator top 72. Fluid enters the surface distribution channel 110 from the tube 40 when the actuator 24 (not shown) is depressed. The surface distribution channel 110 may span a significant portion of the actuator top surface 74. For example, the maximum length 112 of the surface distribution channel 110 across the top surface 74 may be from about 60 to about 95% of the length 78 of the top surface 74. Similarly, the maximum width 114 of the surface distribution channel 110 across the top surface 74 may be from about 60 to about 95% of the width 79 of the top surface 74. A flexible layer 118 may be attached to the top surface 74 of the actuator top 72. The flexible layer 118 may be made of, for example, silicone, thermal plastic elastomer, low density polyethylene or the like. Holes 120 may be formed in the flexible layer 118 to allow fluid to pass from the surface distribution channel 110 to a top surface 122 of the flexible layer 118. Holes 120 are formed on either side of the surface distribution channel 110 as shown in FIG. 20A. When the fluid in the surface distribution channel 110 becomes pressurized, the pressure flexes the flexible layer 118 to allow fluid to pass from the surface distribution channel 110 through the holes 120 and to the top surface 122 of the flexible layer 118. This design may prevent the backflow of fluid from the top surface 122 of the flexible layer 118 to the tube 40, thereby potentially contaminating the contents of the container (not shown).

Figure 20B:
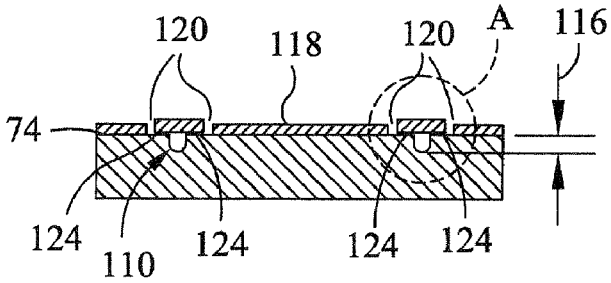
FIG. 20B shows a cross-sectional view along line 20B-20B of FIG. 20A.

FIG. 20B shows a cross-sectional view along line 20B-20B of FIG. 20A. The surface distribution channel 110 may have a depth 116 from about 1 mm to about 20 mm. The actual depth 116 may be chosen depending on the application. A deeper depth 116 may allow more fluid to be dispensed in a single actuation of the pump and may be useful in those applications where a larger volume of fluid is needed. When the fluid in the surface distribution channel 110 is pressurized, the flexible layer 118 may flex at points 124 along either side of the surface distribution channel 110, thereby allowing fluid to pass into the holes 120. While FIGS. 20A and 20B have an X-shaped surface distribution channel 110, any configuration of the surface distribution channel 110 may be used so long as the surface distribution channel 110 passes over tube 40.

Figure 20C:
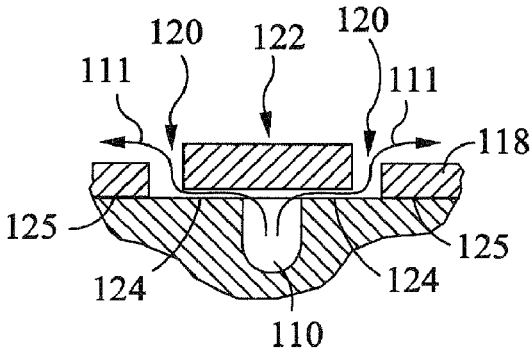
FIG. 20C shows a close up view of region A of FIG. 20B.

FIG. 20C shows a close up view of region A of FIG. 20B. When the fluid in the surface distribution channel 110 is pressurized, the flexible layer 118 may flex at points 124 as shown in FIG. 20C. This flexing of the flexible layer 118 allows fluid to flow along the path as shown by the arrow 111, from the surface distribution channel 110, through points 124, out through holes 120 and to the actuator top surface 74. Flexing of the flexible layer 118 is prevented in areas 125 away from the holes 120 by affixing the flexible layer 118 to the actuator top surface 74. The flexible layer 118 may be affixed to the actuator top surface 74 by any conventional means, such as with an adhesive, such as a glue or an epoxy.

Figure 21A:
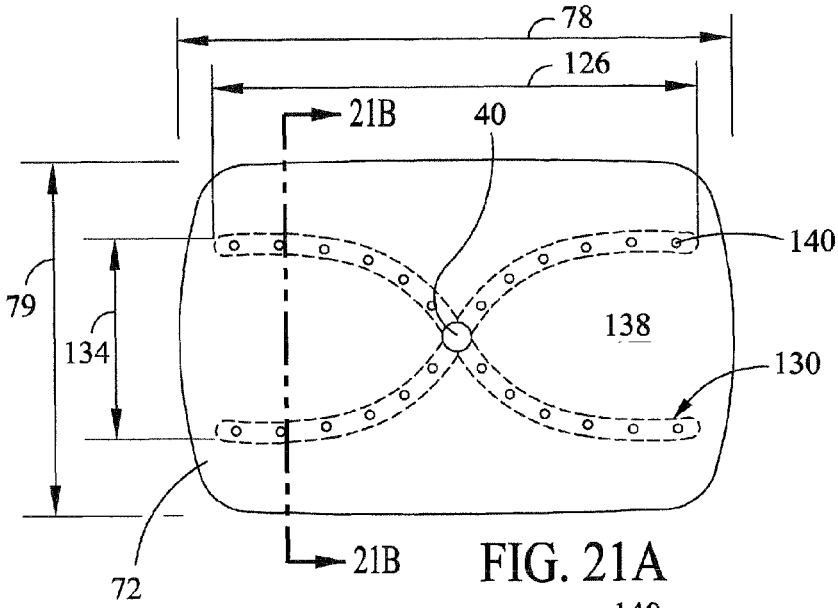
FIG. 21A shows a cross-sectional view of an embodiment of a fluid distribution system of the present invention.

FIG. 21A shows an embodiment of a fluid distribution system having a surface distribution channel 130 along the top surface 74 of the actuator top 72. Fluid enters the surface distribution channel 130 from the tube 40 when the actuator 24 (not shown) is depressed. The surface distribution channel 130 may span a significant portion of the actuator top surface 74. For example, the maximum length 132 of the surface distribution channel 130 across the top surface 74 may be from about 60 to about 95% of the length 78 of the top surface 74. Similarly, the maximum width 134 of the surface distribution channel 130 across the top surface 74 may be from about 60 to about 95% of the width 79 of the top surface 74. A flexible layer 138 may be attached to the top surface 74 of the actuator top 72. The flexible layer 138 may be made of, for example, silicone, thermal plastic elastomer, low density polyethylene or the like. Holes 140 may be formed in the flexible layer 138 to allow fluid to pass from the surface distribution channel 130 to a top surface 142 of the flexible layer 138. Holes 140 are formed directly above the surface distribution channel 110 as shown in FIG. 18A. When the fluid fills the surface distribution channel 110, fluid may then pass through the holes 140 to the top surface 142 of the flexible layer 138.

Figure 21B:
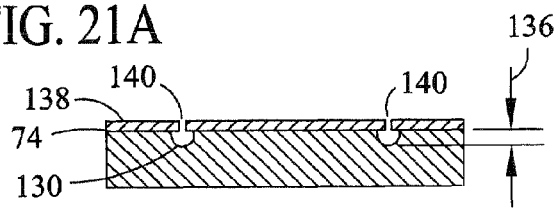
FIG. 21B shows a cross-sectional view along line 21B-21B of FIG. 21A.

FIG. 21B shows a cross-sectional view along line 21B-21B of FIG. 18A. The surface distribution channel 130 may have a depth 136 from about 1 mm to about 20 mm. The actual depth 136 may be chosen depending on the application. A deeper depth 136 may allow more fluid to be dispensed in a single actuation of the pump and may be useful in those applications where a larger volume of fluid is needed. While FIGS. 21A and 21B have an X-shaped surface distribution channel 140, any configuration of the surface distribution channel 140 may be used so long as the surface distribution channel 140 passes over tube 40.

Figure 22A:
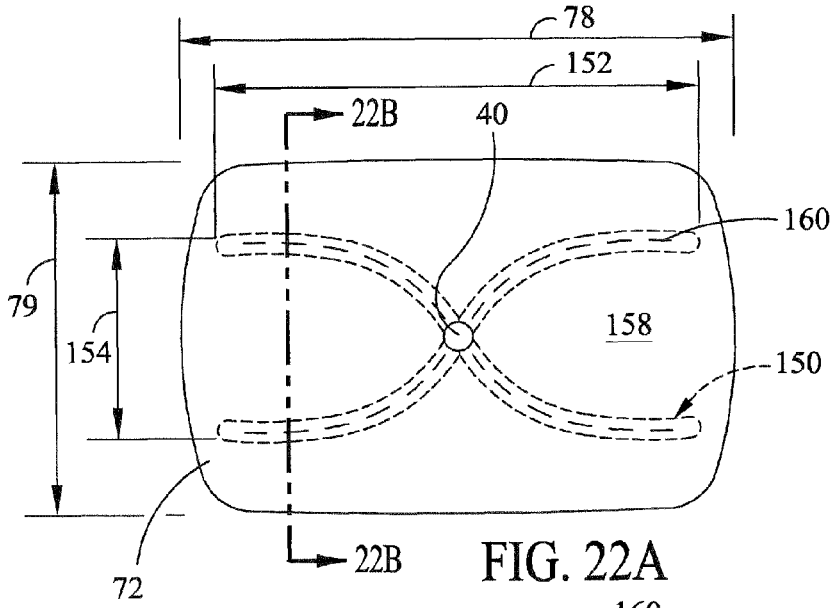
FIG. 22A shows a cross-sectional view of an embodiment of a fluid distribution system of the present invention.

FIG. 22A shows an embodiment of a fluid distribution system having a surface distribution channel 150 along the top surface 74 of the actuator top 72. Fluid enters the surface distribution channel 150 from the tube 40 when the actuator 24 (not shown) is depressed. The surface distribution channel 150 may span a significant portion of the actuator top surface 74. For example, the maximum length 152 of the surface distribution channel 150 across the top surface 74 may be from about 60 to about 95% of the length 78 of the top surface 74. Similarly, the maximum width 154 of the surface distribution channel 150 across the top surface 74 may be from about 60 to about 95% of the width 79 of the top surface 74. A flexible layer 158 may be attached to the top surface 74 of the actuator top 72. The flexible layer 158 may be made of, for example, silicone, thermal plastic elastomer, low density polyethylene or the like. Slits 160 may be formed in the flexible layer 158 to allow fluid to pass from the surface distribution channel 150 to a top surface 162 of the flexible layer 158. Slits 160 are formed over the surface distribution channel 150 as shown in FIG. 22A. When the fluid in the surface distribution channel 150 becomes pressurized, the pressure flexes the flexible layer 158 to open the slits 160 to allow fluid to pass from the surface distribution channel 150 through the holes 160 and to the top surface 162 of the flexible layer 158. This design may prevent the backflow of fluid from the top surface 162 of the flexible layer 158 to the tube 40, thereby potentially contaminating the contents of the container (not shown).

Figure 22B:
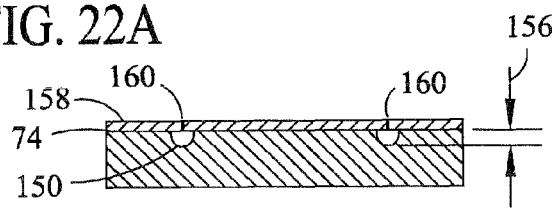
FIG. 22B shows a cross-sectional view along line 22B-22B of FIG. 22A.

FIG. 22B shows a cross-sectional view along line 22B-22B of FIG. 22A. The surface distribution channel 150 may have a depth 156 from about 1 mm to about 20 mm. The actual depth 156 may be chosen depending on the application. A deeper depth 156 may allow more fluid to be dispensed in a single actuation of the pump and may be useful in those applications where a larger volume of fluid is needed. While FIGS. 22A and 22B have an X-shaped surface distribution channel 150, any configuration of the surface distribution channel 150 may be used so long as the surface distribution channel 150 passes over tube 40.

Figure 23A:
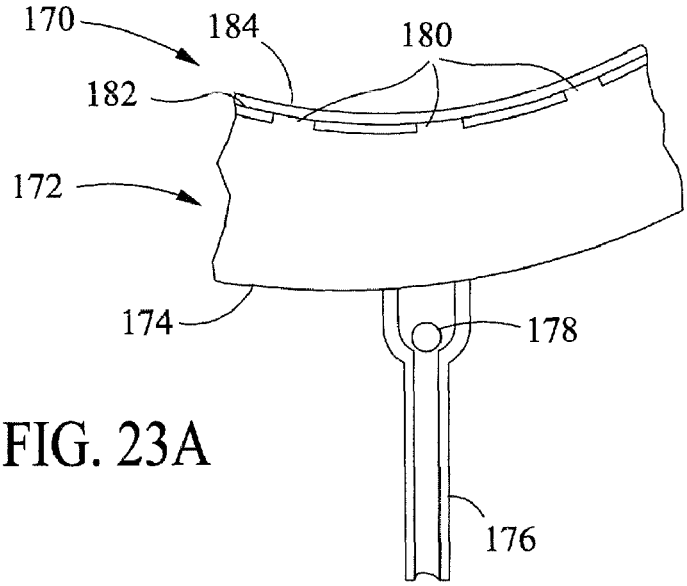
FIG. 23A shows a cross-sectional view of a fluid distribution system having a bellows-type pump according to an embodiment of the present invention.

FIG. 23A shows a cross-sectional view of a fluid distribution system 170 having a bellows-type pump 172 according to an embodiment of the present invention. The bellows-type pump 172 may include a bellows 174 made of flexible material which may be compressed by pressing on the actuator top 72. A dip tube 176 may receive fluid from a container (not shown) when the bellows 174 is compressed to a compressed volume and allowed to expand to its resting volume. A check ball 178 or any conventional check valve may be used to keep fluid accumulated in the bellows 174 from moving back down the dip tube 176 by the force of gravity and the pressure generated during actuation. The bellows-type pump 172 may be of conventional design such that, upon compression and expansion of the bellows 174, fluid may be drawn up the dip tube 176 into the bellows 174. Unlike conventional bellows-type pumps, however, the bellows-type pump 172 of the present invention may have a fluid distribution system 170 integrated therein.

The fluid distribution system 170 allows for the expulsion of fluid from inside the bellows 174 to the actuator top 72. Orifices 180 may be present in the top 182 of the bellows 174. On top of the bellows top 182 is a flexible layer 184. The flexible layer 184 may be similar to the flexible layer described with reference to FIG. 20A through FIG. 22B. The flexible layer 184 may operate in one of two possible configurations as described below.

Figure 23B:
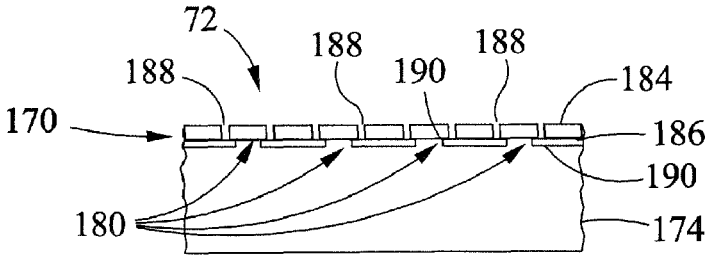
FIG. 23B shows a detailed view of the top surface of the fluid distribution system of FIG. 23A.

FIG. 23B shows a detailed view of the top surface of the fluid distribution 170 of FIG. 23A according to one embodiment of the present invention. The orifice 180 may fluidly connect the inside of the bellows 174 with a bottom surface 186 of the flexible layer 184. The flexible layer 184 may have holes 188 formed therethrough communicating the bottom surface 186 of the flexible layer 184 with the actuator top 72. These holes 188 may be formed on at least one side of the orifice 180. In other words, the holes 188 are not formed directly over the orifice 180. When the fluid in the bellows 174 is pressurized by compressing the bellows 174 (by conventional operation of the bellows-type pump 172), the flexible layer 184 may flex at points 190 along either side of the orifice 180, thereby allowing fluid to pass into the holes 188 and to the actuator top 72.

Figure 23C:
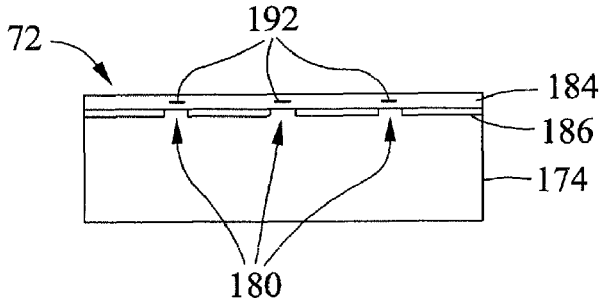
FIG. 23C shows a cross-sectional view of a fluid distribution system according to another embodiment of the present invention.

FIG. 23C shows a cross-sectional view of the fluid distribution system 170 and bellows-type pump 172 according to an alternate embodiment of the present invention. The orifice 180 may fluidly connect the inside of the bellows 174 with a bottom surface 186 of the flexible layer 184. The flexible layer 184 may have slits 192 formed therein which, when opened, communicate the bottom surface 186 of the flexible layer 184 with the actuator top 72. These slits 192 may be formed directly over the orifices 180. When the fluid in the bellows 174 is pressurized by compressing the bellows 174 (by conventional operation of the bellows-type pump 172), the pressure may force the slits to flex and create an opening which allows fluid to flow through the slits 192 to the actuator top 72. When the fluid in the bellows 174 is not pressurized, the slits 192 may be closed to keep fluid from the actuator top 72 from entering the bellows 174 and contaminating fluid therein and to keep air from entering the bellows and discharging the vacuum which is required to draw fluid up the dip tube. A simple linear slit is shown, but the slit could be non-linear (e.g. an arc) or could be a compound slit composed of intersecting slits.

Figure 24A:
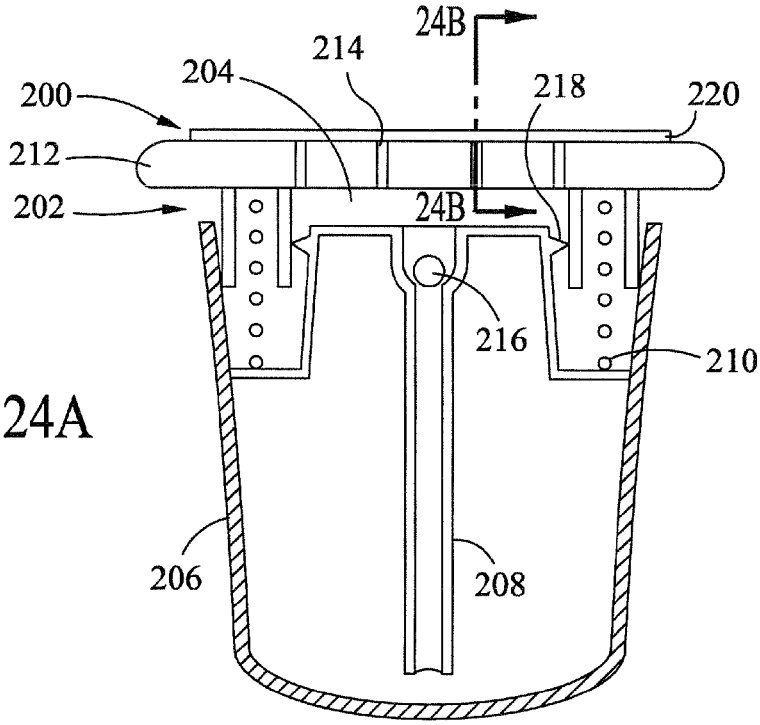
FIG. 24A shows cross-sectional view of a fluid distribution system and a fluid pump according to an embodiment of the present invention.

FIG. 24A shows a cross-sectional view of a fluid distribution system 200 and a fluid pump 202 according to an embodiment of the present invention. By increasing a volume 204 inside the pump 202, fluid may be drawn from the container 206, through a dip tube 208 and into the inside volume 204. A spring 210 may be used to keep an actuator 212 in a raised position (that is, so that the volume 204 inside the pump 202 is at a maximum, this position being referred to as the pump's resting volume). When the actuator 212 is depressed, the spring 210 is resiliently compressed, a conventional check valve, such as a check ball 216, seals the dip tube 208, and fluid inside the volume 204 is expelled from the pump 202 via orifices 214, as described in more detail below. As the spring 210 returns the actuator 212 to its raised position, the check ball 216 allows fluid to flow from the container 206, through the dip tube 208, and back into the inside volume 204. A seal 218 may be present to keep fluid from leaking out of the inside volume 204.

The fluid distribution system 200 allows for the expulsion of fluid from an inside volume 204 to the actuator top 72. Orifices 214 may be present in the actuator 212. On top of the actuator 212 is a flexible layer 220. The flexible layer 220 may be similar to the flexible layer described with reference to FIG. 20A through FIG. 23C. The flexible layer 220 may operate in one of two possible configurations as described below.

Figure 24B:
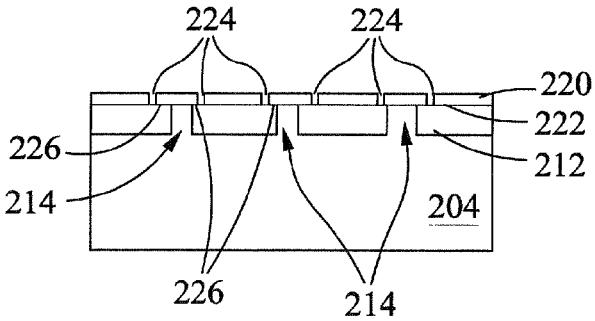
FIG. 24B shows a cross-sectional view taken along line 24B-24B according to one embodiment of the present invention.

FIG. 24B shows a cross-sectional view taken along line 24B-24B of FIG. 24A of the fluid distribution system 200 and fluid pump 202 according to one embodiment of the present invention. The orifice 214 may fluidly connect the inside volume 204 of the pump 202 with a bottom surface 222 of the flexible layer 220. The flexible layer 220 may have holes 224 formed therethrough communicating the bottom surface 222 of the flexible layer 220 with the actuator top 72. These holes 224 may be formed on at least one side of the orifice 214. In other words, the holes 224 are not formed directly over the orifice 214. When the fluid in the inside volume 204 is pressurized by compressing the actuator 212 (by conventional operation of the dispensing package), the flexible layer 220 may flex at points 226 along either side of the orifice 214, thereby allowing fluid to pass into the holes 224 and to the actuator top 72.

Figure 24C:
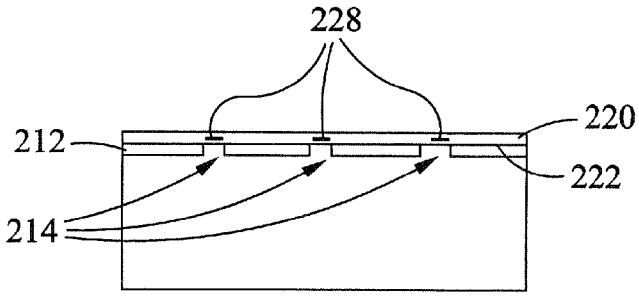
FIG. 24C shows a cross-sectional view taken along line 24B-24B according to another embodiment of the present invention.

FIG. 24C shows a cross-sectional view taken along line 24B-24B of FIG. 24A of the fluid distribution system 200 and fluid pump 202 according to an alternate embodiment of the present invention. The orifice 214 may fluidly connect the inside volume 204 of the pump 202 with a bottom surface 222 of the flexible layer 220. The flexible layer 220 may have slits 228 formed therethrough communicating the bottom surface 222 of the flexible layer 220 with the actuator top 72. These slits 228 may be formed directly over the orifices 214. When the fluid in the inside volume 204 is pressurized by compressing the actuator 212 (by conventional operation of the dispensing package), the pressure may force fluid to flow through the slits 228 to the actuator top 72. When the fluid in the inside volume 204 is not pressurized, the slits 228 may be closed to keep fluid from the actuator top 72 from entering the inside volume 204 of the pump 202 and contaminating fluid therein.

While not specifically shown in a figure, the present invention contemplates combinations of the above disclosed embodiments of the invention. For example, the top 182 of the bellows 174 described in FIG. 23A may have a single orifice communicating fluid to a surface distribution channel as described in one of FIG. 20A through FIG. 22B. The flexible layer 184 (FIG. 23A) may then be configured as described in either FIG. 20B (with holes on either side of the surface distribution channel) or FIG. 22B (with slits directly over the surface distribution channel).

Additional Functional Features

In one embodiment, additional functional characteristics designed into the container base to offer stability and to encourage consumers to leave the product out on their counters so it is easily accessible. In one embodiment, a means is provided to allow the container to attach to the counter. One such example is a suction cup or other device on the bottom of the container. In addition to standing upright, for example on a counter-top, the dispenser package may be attached to a surface and used with the dispenser package orifices on the bottom, for example attached to the underside of kitchen cabinets.

In one embodiment, the exterior of the package dispenser is resistant to microorganisms. Various anti-microbial agents known in the art can be applied the exterior surface of the package dispenser to impart virucidal, bacterial, and/or germicidal properties thereto. The anti-microbial agent can comprise up to 100% of the surface area of the exterior surface of the dispenser, and in some embodiments, between about 10% to about 80%. The anti-microbial agent can include silver ions. In certain embodiments, a silver-zeolite complex can be utilized to provide controlled release of the anti-microbial agent. One commercially available example of such a time-release anti-microbial agent is sold as a fabric by HEALTH SHIELD® under the name GUARDTEX®, and is constructed from polyester and rayon and contains a silver-zeolite complex. Other suitable silver-containing microbial agents are disclosed in Japanese Unexamined Patent No. JP 10/259,325. Moreover, in addition to silver-zeolites, other metal-containing inorganic additives can also be used in the present invention. Examples of such additives include, but are not limited to, copper, zinc, mercury, antimony, lead, bismuth, cadmium, chromium, thallium, or other various additives, such as disclosed in Japanese Patent No. JP 1257124 A and U.S. Pat. No. 5,011,602 to Totani, et al. In some embodiments, the activity of the additive can also be increased, such as described in U.S. Pat. No. 5,900,383 to Davis, et al.

Substrate

Potential substrates or tools that consumers could use with the package dispenser include woven or nonwoven dish cloths, sponges, paper towel, hands, facial tissue, bathroom tissue, paper, napkins, woven and nonwoven substrates, towels, wipes, and cotton balls. The package dispenser could also be used with clothes for stain removal purposes. Suitable substrates can comprise personal, cosmetic or sanitary wipes, baby wipes, hand wipes, wipes used in car cleaning, household or institutional cleaning or maintenance, computer cleaning and maintenance and any other area in which a flexible substrate having a useful liquid treatment composition has application. These substates (tissues or wipes) can be made from simple nonwovens, complex nonwovens or treated, high-strength durable materials. The substrate can be two-sided or have a barrier so that only one side is wet with the composition upon use. Such substrates are described in U.S. Pat. App. 2005/0079987 to Cartwright et al.

Compositions

The composition can contain virtually any useful liquid compositions. Simple liquids such as water, alcohol, solvent, etc. can be useful in a variety of end uses, particularly cleaning and simple wiping applications. The liquid can be a simple cleaner, maintenance item or a personal care liquid suitable for dermatological contact with an adult, child or infant. Such compositions can be used in hospitals, schools, offices, kitchens, secretarial stations, etc. The compositions can also comprise more complex liquids in the forms of solutions, suspensions or emulsions of active materials in a liquid base. In this regard, such compositions can be active materials dissolved in an alcoholic base, aqueous solutions, water in oil emulsions, oil in water emulsions, etc. Such compositions can be cleaning materials, sanitizing materials, or personal care materials intended for contact with human skin, hair, nails, etc. Cleaning compositions used generally for routine cleaning operations not involving contact with human skin can often contain a variety of ingredients including, in aqueous or solvent base, a soil-removing surfactant, sequestrants, perfumes, etc. in relatively well-known formulations. Sanitizing compositions can contain aqueous or alcoholic solutions containing sanitizing materials such as triclosan, hexachlorophene, betadine, quaternary ammonium compounds, oxidizing agents, acidic agents, and other similar materials. Such compositions can be designed for treating or soothing human skin, including moisturizers, cleansing creams and lotions, cleansers for oily skin, deodorants, antiperspirants, baby-care products, sun block, sun screen, cosmetic-removing formula, insect repellent, etc. Moisturizer materials are preparations that reduce water loss or the appearance of water loss from skin. Cleansing creams or lotions can be developed that can permit the formulation to dissolve or lift away soil pigments, grime and dead skin cells. These creams or lotions can also be enhanced to improve removability of makeup and other skin soils. Cleaners for oily skin are often augmented with ethyl alcohol or isopropyl alcohol to increase the ability of the cleaner to remove excess oily residue. Deodorants and antiperspirants often contain, in an aqueous base, dispersions or emulsions comprising aluminum, zinc or zirconium compounds.

The composition may contain one or more additional surfactants selected from nonionic, anionic, cationic, ampholytic, amphoteric and zwitterionic surfactants and mixtures thereof. A typical listing of anionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, anionic, ampholytic, amphotenic and zwitteronic surfactants are generally used in combination with one or more nonionic surfactants. The surfactants may be present at a level of from about 0% to 90%, or from about 0.001% to 50%, or from about 0.01% to 25% by weight.

The compositions may contain suitable organic solvents including, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tripolypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. The solvents can be present at a level of from 0.001% to 10%, or from 0.01% to 10%, or from 1% to 4% by weight.

The compositions optionally contain one or more of the following adjuncts: stain and soil repellants, lubricants, odor control agents, perfumes, fragrances and fragrance release agents, and bleaching agents. Other adjuncts include, but are not limited to, acids, electrolytes, dyes and/or colorants, solubilizing materials, stabilizers, thickeners, defoamers, hydrotropes, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Suitable organic acid can be selected from the group consisting of citric acid, lactic acid, malic acid, salicylic acid, acetic acid, adipic acid, fumaric acid, hydroxyacetic acid, dehydroacetic acid, glutaric acid, tartaric acid, fumaric acid, succinic acid, propionic acid, aconitic acid, sorbic acid, benzoic acid, gluconic acid, ascorbic acid, alanine, lysine, and mixtures thereof. Electrolytes, when used, include, calcium, sodium and potassium chloride. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide. When cleaning food contact surfaces, compositions for use herein may contain only materials that are food grade or GRAS, including, of course, direct food additives affirmed as GRAS, to protect against possible misuse by the consumer.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard® and/or Glydant®) and/or short chain alcohols (e.g. ethanol and/or IPA). The mildewstat or bacteriostat includes, but is not limited to, mildewstats (including non-isothiazolone compounds) include Kathon® GC, a 5-chloro-2-methyl-4-isothiazolin-3-one, Kathon® ICP, a 2-methyl-4-isothiazolin-3-one, and a blend thereof, and Kathon® 886, a 5-chloro-2-methyl-4-isothiazolin-3-one, all available from Rohm and Haas Company; BRONOPOL®, a 2-bromo-2-nitropropane 1,3 diol, from Boots Company Ltd., PROXEL® CRL, a propyl-p-hydroxybenzoate, from ICI PLC; NIPASOL® M, an o-phenyl-phenol, $Na^+$ salt, from Nipa Laboratories Ltd., DOWICIDE® A, a 1,2-Benzoisothiazolin-3-one, from Dow Chemical Co., and IRGASAN® DP 200, a 2,4,4'-trichloro-2-hydroxydiphenylether, from Ciba-Geigy A.G.

The compositions can contain antimicrobial agents, including 2-hydroxycarboxylic acids and other ingredients, including quaternary ammonium compounds and phenolics. Non-limiting examples of these quaternary compounds include benzalkonium chlorides and/or substituted benzalkonium chlorides, di(C6-C14)alkyl di-short chain (C1-4 alkyl and/or hydroxyalkl) quaternary ammonium salts, N-(3-chloroallyl) hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethyl-benzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are also in this class. Another class of antibacterial agents, which are useful in the present invention, are the so-called "natural" antibacterial actives, referred to as natural essential oils. These actives derive their names from their natural occurrence in plants. Typical natural essential oil antibacterial actives include oils of anise, lemon, orange, rosemary, wintergreen, thyme, lavender, cloves, hops, tea tree, citronella, wheat, barley, lemongrass, cedar leaf, cedarwood, cinnamon, fleagrass, geranium, sandalwood, violet, cranberry, eucalyptus, vervain, peppermint, gum benzoin, basil, fennel, fir, balsam, menthol, ocmea origanum, Hydastis carradenisis, Berberidaceae daceae, Ratanhiae and Curcunta longa. Also included in this class of natural essential oils are the key chemical components of the plant oils which have been found to provide the antimicrobial benefit. These chemicals include, but are not limited to anethol, catechole, camphene, carvacol, eugenol, eucalyptol, ferulic acid, farnesol, hinokitiol, tropolone, limonene, menthol, methyl salicylate, thymol, terpineol, verbenone, berberine, ratanhiae extract, caryophellene oxide, citronellic acid, curcumin, nerolidol and geraniol. Other suitable antimicrobial actives include antibacterial metal salts. This class generally includes salts of metals in groups 3*b*-7*b*, 8 and 3*a*-5*a*. Specifically are the salts of aluminum, zirconium, zinc, silver, gold, copper, lanthanum, tin, mercury, bismuth, selenium, strontium, scandium, yttrium, cerium, praseodymiun, neodymium, promethum, samarium, europium, gadolinium, terbium, dysprosium, holmium, erbium, thulium, ytterbium, lutetium and mixtures thereof.

When the composition is an aqueous composition, water can be, along with the solvent, a predominant ingredient. The water should be present at a level of less than 99.9%, more preferably less than about 99%, and most preferably, less than about 98%. Deionized water is preferred. Where the cleaning composition is concentrated, the water may be present in the composition at a concentration of less than about 85 wt. %.

The dispenser can be used to transfer a wide variety of compositions to a substrate. These compositions include hard surface cleaners and sanitizers, personal care cleaners and other products, hand sanitizers, dish soap, laundry pre-treater, food products such as marinades, car products such as cleaners or protectants, and baby care products such as baby lotion. Also, suitable are compositions, such as hypochlorite especially dilute (below 500 ppm) hypochlorite, that lack good stability on nonwoven substrates. Other examples of compositions that may lack stability are quaternary ammonium disinfectants or metal ions that can bind to nonwoven substrates.

In one embodiment, the substrate can undergo a color change or other physical property change during the process of application using the dispenser or during the cleaning process. These changes can include color change due to the addition of a colorless cleaner/disinfectant, color change due to the addition of a composition containing a dye, color change when dye is thermochromic, and changes over time as solvent evaporates to cool the wipe, a color change due to reaction of solvent with a pre-bound species (e.g. transition metals) on the wipe, texture changes in the non-woven, and the impact of the using a dyed or patterned non-woven. The composition or substrate can incorporate solvatochromic dyes to indicate the presence of bacteria as described in U.S. Pat. App. 2005/0130253. In one embodiment, the composition contains a dye that interacts with proteins or bacterial on surfaces to indicate whether the surface is substantially free of soil (protein) or bacteria. In one embodiment, the soil or bacteria is detected on the substrate. In one embodiment, the soil or bacteria is detected on the surface. Colorimetric assays utilizing sampling devices for the detection of protein in biological samples are commonly used across various industries (biotech, healthcare, food, etc). These sampling devices require minimal manipulation of the protein-containing samples and allow for rapid qualitative and quantitative results. Among the various available calorimetric protein assays is one disclosed in U.S. Pat. No. 4,839,295 to Smith, incorporated herein in its entirety, that utilizes a Bicinchonic Acid (BCA) protein assay. This assay is based on the initial complexation of Copper [II], hereinafter $Cu^{++}$ or cupric ion, with protein peptides under alkaline conditions, with the reduction to Copper [I], hereinafter $Cu^{+}$ or the cuprous ion, in a concentration-dependent manner. The ligand BCA is then added in excess, and a purple color develops (562 nm peak absorbance) upon binding of BCA with $Cu^{+}$. Suitable detection devices are described in U.S. patent application Ser. No. 11/397,522 to Cumberland et al. filed Apr. 3, 2006 and U.S. patent application Ser. No. 11/427,469 to Cumberland et al. filed Jun. 29, 2006.

Methods of Use

Consumers enjoy the ease of use of the invention for reasons such as it utilizes cleaners differently, provides control such as no overspray, can be used one-handed, is compatible with wide variety of substrates, utilizes direct application so that no particles are aerosolized into the air, allows easy multi-tasking with other household activities, and is not limited by number of doses or wipes. Because of this flexibility, the consumer has more control to make the exact use conditions suitable to the task.

The dispensing package can be used as a one-handed method of cleaning a surface, where the consumer grabs a substrate in her hand, pushes the substrate down on the reciprocating actuator top of the dispensing package with her hand, allows the actuator top to come up and discharge a cleaning composition from the dispensing package to the substrate, and wipes the surface with the substrate. The substrate can be a paper towel, facial tissue, sheet of toilet tissue, a napkin, a sponge, a towel, the consumer's fingers or any other suitable woven or nonwoven substrate. Because the cleaning task takes only one hand, the other hand is free to perform another activity, such as holding a telephone, eating a snack and the task can be done quickly and easily without carrying the dispensing package to the area of the task.

Figure 9:
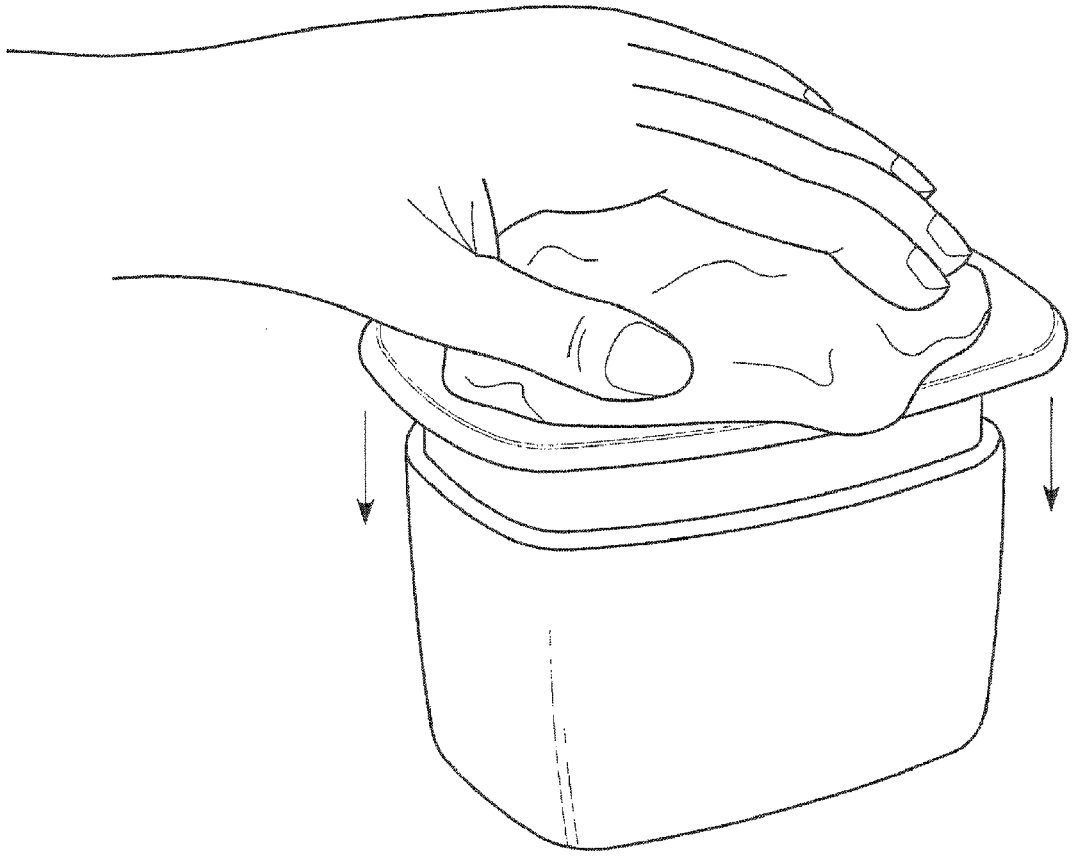
FIG. 9 shows the one-handed use of the package with a paper towel.
Figure 10:
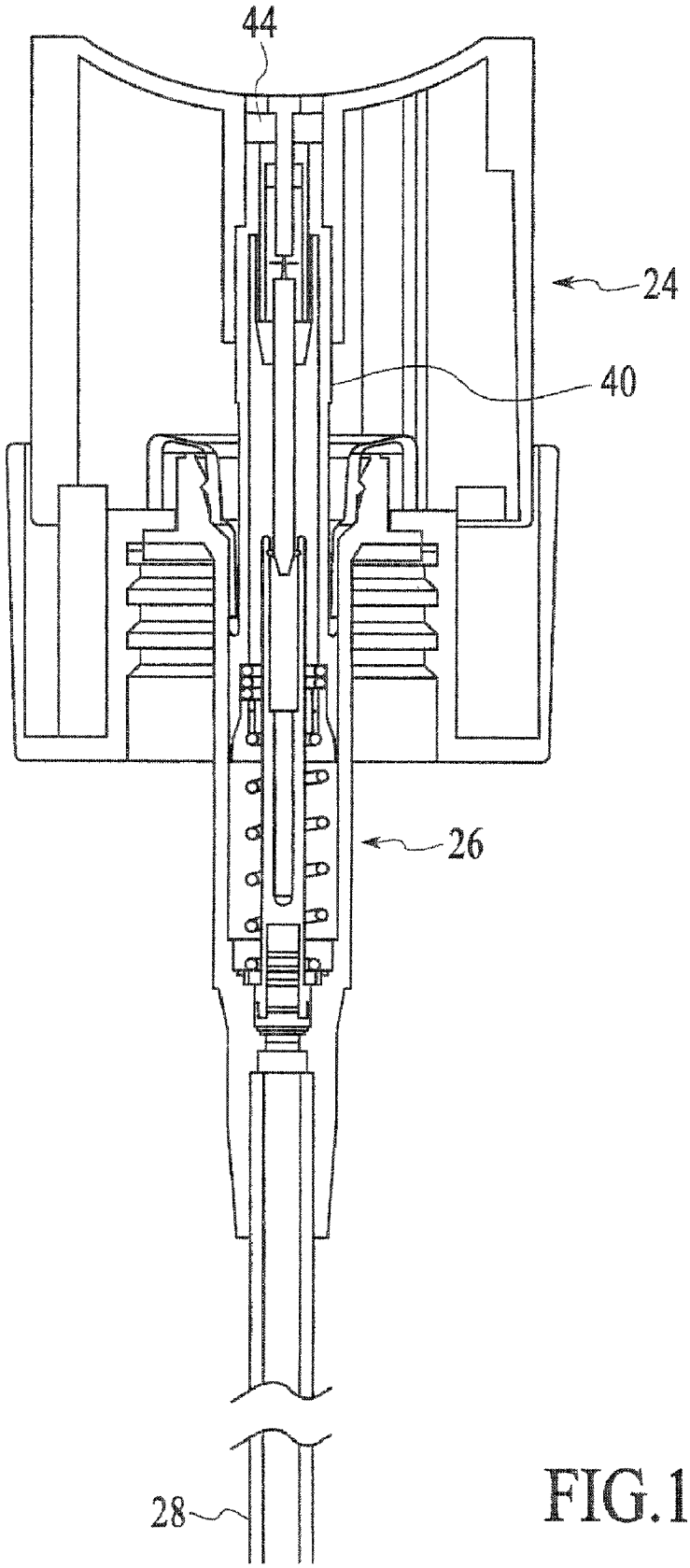
FIG. 10 is a cross-sectional view of an embodiment of the pump dispenser of the present invention taken generally along the plane 10-10 in FIG. 1.

Because the consumer is unfamiliar with the one-handed method of cleaning a surface, certain use indications on the dispensing package, any exterior packaging, or on advertising may be necessary to provide the consumer instant instruction on the use of the dispensing package. In one embodiment, a hand is depicted over the dispensing package. In another embodiment, a hand holding a substrate is depicted over the dispensing package. In another embodiment, a hand holding a substrate (with an arrow pointing down) is depicted over the dispensing package, as shown in FIG. 9.

This method of cleaning of the invention has several advantages. If the consumer is preparing dinner and using one hand to contact raw food such as chicken that may contain microorganisms, then the consumer can use the other hand to do one-handed cleaning and disinfection of the food preparation surface, such as a countertop. Using a traditional cleaning product, such as a spray bottle and paper towel, the consumer picks up the spray bottle with the hand that has been potentially contaminated with microorganisms and transfers those microorganisms to the spray bottle. If the spray bottle or other product dispenser is contaminated with microorganisms, then the consumer can pick up and transfer microorganisms from the product dispenser. In the case of the one-handed method of the invention, the consumer contacts the product dispenser only at the actuator component which dispenses the disinfecting composition. In this case, there is less likelihood of transmission of microorganisms from dispenser to hands or from hands to dispenser.

Another advantage of the method and package of the present invention is control during delivery of the composition. With traditional spray dispensers, the consumer must attempt to fit the spray pattern of the spray bottle dispenser to the area to be cleaned. Frequently, the cleaning surface contains additional items, such as food or decorative items, which the consumer may not wish to contact with the cleaning composition. With the method and dispenser package of the invention, the consumer can controllably apply the composition to the substrate and then controllably apply the substrate containing the composition to the cleaning surface. If the consumer were to try spraying the substrate with a traditional spray dispenser, then some of the composition would be aerosolized into the air and some of the composition would miss the substrate and contact other surfaces such as the hand or food items.

Another area of concern for consumers is microorganism contaminated surfaces within the bathroom, especially around the toilet area. Consumers have ready access to toilet tissue but no ready mechanism to use it for spot cleaning. The method of the invention allows the consumer to use toilet tissue, which has limited wet strength and scrubbing strength, to spot clean surfaces around the toilet and other bathroom surfaces without using two hands and without having to pick up the dispensing package. With a suitable composition within the dispensing package, the consumer may also use the dispensing package and method of the invention for personal hygiene use.

With traditional dispensers such as trigger sprayers, the consumer has limited ability to control the pattern of dispensing the composition onto a surface or a substrate. In one case, the substrate, such as sponges, may be rectangular and the dispensing system may deliver a circular application of product. To effectively apply product to a substrate, such as a sponge, it may be desirable to apply the composition in a rectangular or oval fashion, where the applied product is dispersed more in one dimension than in the other dimension. Additionally, with the hand or a paper towel in a hand or a toilet tissue in a hand, it may also be desirable to apply the composition to the substrate in a non-circular fashion or where one dimension is greater than another. The method of the invention has the advantage that with a properly designed actuator component and orifices in the activator component, it may be possible to apply a non-circular pattern with one hand motion.

Some suitable substrates will not be stable long-term to all suitable compositions, for example toilet tissue or a sheet of facial tissue quickly loses its tensile strength when saturated with cleaning composition. Therefore, it is most suitable to wet the toilet tissue or facial tissue just before use. In some cases, the substrate loses at least 40%, or 50%, or 60%, or 70%, or 80%, or 90% peak dry tensile strength in machine or cross direction upon being loaded to full saturation with the composition. Peak dry tensile strength is the maximum load that a substrate can bear before breaking\rupturing under tension. With the method of the invention, these substrates may be useful for spot cleaning.

Other compositions are not stable on typical substrates, for example hypochlorite, especially dilute hypochlorite, is not storage stable on most nonwoven substrates as described in U.S. Pat. No. 7,008,600 to Katsigras et al. Additionally, compositions of very high or low pH are not generally storage stable on wipes or paper towels. Disinfectant compositions containing quaternary ammonium disinfectants or other cationic disinfectants bind to most nonwovens, especially cellulosic nonwovens, on storage so that they are not effectively released. The extent of binding can be measured by a quaternary recovery measurement on the wet substrate. The liquid squozate is acquired from the substrate by centrifugation after a seven day minimum requisite time of substrate-lotion equilibration. Substrates are put into a centrifuged tube for analysis, centrifuged at 3000 rpm for 15 min, and the liquid analyzed by HPLC. At equilibrium, the quaternary disinfectant show substantial binding to the substrate, for example, at least 10%, or 20%, or 30%, or 40%, or 50% by weight. However, the method of the invention, since it is quick and easy, lends itself to use of unstable substrates and unstable compositions, which may not be suitable under other methods of use.

The present invention relates to disinfecting compositions which can be used to disinfect various surfaces including inanimate surfaces such as hard surfaces like walls, tiles, floors, countertops, tables, glass, bathroom surfaces, and kitchen surfaces. The hard-surfaces to treat with the compositions herein are those typically found in houses like kitchens, bathrooms, e.g., tiles, walls, floors, chrome, glass, smooth vinyl, any plastic, plasticized wood, table top, sinks, cooker tops, dishes, sanitary fittings such as sinks, showers, shower curtains, wash basins, toilets and the like. Hard-surfaces also include household appliances including, but not limited to, refrigerators, freezers, washing machines, automatic dryers, ovens, microwave ovens, dishwashers and so on.

The dispenser package can be used around the house, for example, on kitchen or bathroom surfaces. The dispenser package can be used in public places, for example, in schools and school classrooms. For use around food, a food safe cleaner or disinfectant is suitable. The dispenser package allows the user to quickly apply a sanitizing or cleaning solution to everyday cleaning tools, such as sponges, paper towels, toilet paper, facial tissue, etc. When applied, the sanitizing or cleaning solution transforms the everyday cleaning tool into effective cleaning or sanitizing tools.

Additional Embodiments

In one embodiment, the package dispenser is a small palm-sized pouch of liquid cleaner that can be attached to any surface (e.g., side of a paper towel or facial tissue dispenser, under a cabinet, on a refrigerator, etc.) using dual-sided magnets or adhesive. A touch valve releases cleaner onto your paper towel, toilet paper, sponge, rag, etc. when pressure is applied. It then automatically stops dispensing when pressure is relieved to prevent dripping. The unit contains one cleaning packet with adhesive backing and/or two magnets so that the consumer can attach the cleaner packet to any surface using dual-sided magnets. The consumer peels off backing of adhesive strip from cleaning packet, and attaches the packet to the first magnet and positions the cleaning packet in the ideal location. If the surface is not metallic, the consumer can place the second magnet directly behind surface where cleaner is positioned to hold cleaning packet in place.

In one embodiment, the package dispenser is both a gel and mist cleaner. This dispenser is a dual dispensing cleaner that allows you to dispense one cleaner or two different cleaners in two different forms, a gel and a mist or spray. The package has a gel pump on top that works with a top actuator component as described previously and a liquid misting sprayer on the side. The unit contains one cleaning bottle and optionally a wall mounting base and attachments. To use this embodiment, press and pump your paper towel on the cleaning gel actuator component. To use the misting spray, squeeze the trigger on the side.

In one embodiment, the package dispenser is a discreet and mountable cleaner dispenser. This package is a mountable cleaning product package with a press and pump dispenser. The package is thin and discreet, about the size of a flattened tissue box. It can be mounted horizontally or vertically with adhesive to surface of your choice (e.g., under cabinets, side of counter, side of toilet tank, etc.). The unit contains one package dispenser with adhesive back. In another embodiment, the package dispenser is a hangable cleaner that can be hung anywhere (e.g., shower door/curtain rod, towel rack, kitchen cabinet, shower head, etc.) with the hook on top. The dispenser has a valve on the bottom of the bottle that releases the composition when the actuator component is pushed.

In one embodiment, the package dispenser is a mountable or counter standing dispenser that automatically dispenses the composition onto your paper towel, toilet paper, sponge, rag, etc. A sensor on the package dispenser works to activate the actuator component when you hold your paper towel, toilet paper, sponge, rag, etc. under or over the actuator component. The unit package can contain wall-mounting and counter-holding suction cups, dispensing machine, refillable cleaner cartridge and battery. In one embodiment, this package dispenser is plugged into an outlet to run the sensor and pump.

In one embodiment, the package dispenser can be stamped directly onto the cleaning or treatment surface. The consumer presses the entire bottle onto surface so that actuator depresses and product is applied directly to the surface. The consumer can then use whatever substrate she prefers to distribute composition around the surface. The package dispenser can be stored with the actuator component either facing up or down near the surface. If the actuator component faces down to the surface, it would be more ergonomic to apply because the consumer would not have to turn it upside down and twist their wrist. Where it is desirable to leave the composition on the surface for a desired treatment time, such as in fabric stain treatment or some personal care treatments, the composition can be applied directly with the package dispenser and then later treated with the substrate.

In one embodiment, the package dispenser is paper towel holder. The package dispenser can fit in the center of a paper towel or toilet paper role. The actuator component sticks out the top of the roll. The consumer can then easily remove a substrate from the roll and apply product to the substrate. In one embodiment, package dispenser is an aerosolized bottle that provides one-touch application of composition to the substrate. The consumer could press and hold substrate to actuator component until the desired amount of composition was on substrate.

In one embodiment, the product or package contains directions to store the substrate on top of the package, for example a sponge on top of dispensing package actuator. In one embodiment, the product or package includes the dispensing package and substrates sold together, for example paper towels with the dispensing package. In one embodiment, several dispensing packages are bundled in multi-packs, for example a dispensing package containing dish soap and a dispensing package containing a kitchen cleaner. In one example, the dispensing package is sold with one or more refills.

While this detailed description includes specific examples according to the invention, those skilled in the art will appreciate that there are many variations of these examples that would nevertheless fall within the general scope of the invention and for which protection is sought in the appended claims.

What is claimed is:

1. An inside volume system for distributing fluid from a container, the system comprising: a pump having an inside volume compressible to a reduced volume and expandable to a resting volume; a dip tube for fluidly communicating a fluid in the container to the inside volume; an actuator having an actuator top and an actuator top surface and a plurality of orifices in the actuator top surface fluidly connected to the inside volume to permit liquid flow to the actuator top surface upon reciprocation of the actuator top; the actuator having an actuator skirt coupled to the actuator top and depending downwardly from the peripheral edge of the actuator top wherein the skirt exterior surface of the actuator skirt is slideably engagable with an interior surface of the container; and the actuator having a flexible layer overlaying the actuator top surface covering the plurality of orifices and at least one of slits or holes formed in the flexible layer, wherein the slits or holes are not formed directly over the plurality of orifices.

2. The system according to claim 1, further comprising a check valve for preventing fluid to flow from the inside volume into the container when the inside volume is compressed to the reduced volume, thereby allowing the fluid in the inside volume to be pressurized and a spring biasing the actuator in a raised position.

3. The system according to claim 1, wherein pressurization of the fluid in the inside volume lifts a portion of the flexible layer, thereby allowing the fluid to pass through the orifices, through the slits or holes and to the top surface of the flexible layer.

4. A flexible layer system for distributing fluid from a container, the system comprising: a pump having an inside volume compressible to a reduced volume and expandable to a resting volume, the pump being maintained at the resting volume by at least one spring; an actuator forming a top surface of the inside volume; a dip tube for fluidly communicating a fluid in the container to the inside volume; a check ball for preventing fluid to flow from the inside volume into the container when the inside volume is compressed to the reduced volume, thereby allowing the fluid in the inside volume to be pressurized; a plurality of orifices in the actuator; a flexible layer covering the plurality of orifices and forming an actuator top; at least one of slits or holes formed in the flexible layer, wherein the slits or holes are not formed directly over the plurality of orifices.

5. The system according to claim 1, wherein the actuator skirt is visible when the actuator is in an up position and the actuator skirt is indented from the actuator top and the visible portion of the actuator skirt has a vertical dimension of at least one-quarter inch.

6. The system according to claim 5, wherein after downward activation of the system the actuator skirt extends beyond the circumference of the container.

7. The system according to claim 5, wherein the actuator top is about parallel to the container bottom.

* * * * *